US005115281A

United States Patent [19]

Ohtsuka et al.

[11] Patent Number: 5,115,281

[45] Date of Patent: May 19, 1992

[54] IMAGE FORMING APPARATUS WITH PLURAL FORMING UNITS

[75] Inventors: Masahito Ohtsuka, Kawasaki; Hiroo Kobayashi, Tokyo; Toshifumi Moritani, Yokohama; Tadashi Yagi, Machida; Yoshiro Tsuchiya, Yokohama; Takahiro Azeta, Kawasaki; Tsuyoshi Waragai, Tokyo; Hiroshi Yukimachi, Kawasaki; Hiroaki Miyake, Yokohama, all of Japan

[73] Assignee: Canon Kabushiki Kaisha, Tokyo, Japan

[21] Appl. No.: 577,601

[22] Filed: Sep. 5, 1990

[30] Foreign Application Priority Data

| | | | |
|---|---|---|---|
| Sep. 5, 1989 | [JP] | Japan | 1-228393 |
| Oct. 13, 1989 | [JP] | Japan | 1-264895 |
| Oct. 13, 1989 | [JP] | Japan | 1-264897 |
| Oct. 19, 1989 | [JP] | Japan | 1-270405 |
| Nov. 16, 1989 | [JP] | Japan | 1-296155 |
| Nov. 22, 1989 | [JP] | Japan | 1-306073 |
| Nov. 27, 1989 | [JP] | Japan | 1-306817 |

[51] Int. Cl.[5] ..... G03G 21/00

[52] U.S. Cl. ..... 355/319; 271/291; 271/902; 355/308

[58] Field of Search ..... 355/200, 202, 210, 308, 355/317, 319, 321, 322, 309; 271/291, 902

[56] References Cited

U.S. PATENT DOCUMENTS

| | | | |
|---|---|---|---|
| 2,986,466 | 5/1961 | Kaprelian | 355/317 |
| 4,162,843 | 7/1979 | Inoue et al. | 355/317 X |
| 4,586,812 | 5/1986 | Kaneko et al. | 355/319 X |
| 4,591,884 | 5/1986 | Miyamoto et al. | 355/319 X |
| 4,664,501 | 5/1987 | Koizumi et al. | 355/317 X |
| 4,796,050 | 1/1989 | Furuta et al. | 355/317 |
| 4,945,390 | 7/1990 | Hasegawa et al. | 355/321 |
| 4,947,206 | 8/1990 | Ito | 355/321 X |
| 4,958,187 | 1/1990 | Tsuchiya et al. | 355/202 |

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

The present invention provides an image forming apparatus having a first image forming unit incorporating an image formation processing device therein, a sheet supply station for feeding a sheet to the first image forming unit, and a sheet ejecting station for ejecting the sheet on which an image is formed by the first image forming unit out of the image forming apparatus. Wherein a second image forming unit having the same function and size as those of the first image forming unit is mounted within the image forming apparatus and a sheet inlet of the second image forming unit is directly connected to the sheet ejecting station.

13 Claims, 20 Drawing Sheets

IMAGE FORMING APPARATUS WITH PLURAL FORMING UNITS

BACKGROUND OF THE INVENTION

1. Field of the Invention

The present invention relates to an image forming apparatus such as a laser printer, LED printer, ink jet printer and the like.

2. Related Background Art

Recently, as personal computers have been remarkably progressed, various printers used as an output device which is one of peripheral equipments for the personal computer have also been popularized. Particularly, printers which operate at a high speed with less noise and provide a high quality image and which are called "page printers", such as laser printers, LED printers, ink jet printers and the like have been remarkably popularized in the recent years.

On the other hand, since the processing speed of the computers has also been increased, the high functional ability and/or multi-functional ability of the printers have been requested. For example, various printers having high additional functions, such as those of network response type, of double-surface printing type, of multi-print type, of the type having greater ejecting ability, or of the type having greater sheet supply variety have been proposed.

However, in the above-mentioned conventional printers, although the multi-function such as the double-surface print and/or multi-print and the high image forming speed have been attained, there arose a problem that it took a long time to treat a recording medium (transfer sheet) in such a manner that an image was formed in the image forming apparatus and the sheet was then ejected from the image forming apparatus, thus increasing the image forming time.

For example, if the double-surface print or the multi-print is effected, since the conventional image forming apparatus had only one set of image formation processing means such as an image bearing member, it was necessary to treat the same single transfer sheet at least twice by the image formation processing means, with the result that the transfer sheet had to be circulated in the image forming apparatus. Accordingly, the travel distance of the transfer sheet in the image forming apparatus was increased, thus extending the image forming time regarding the transfer sheet.

SUMMARY OF THE INVENTION

The present invention intends to eliminate the above-mentioned conventional drawbacks, and an object of the present invention is to provide an image forming apparatus which has the multi-function and can reduce the image forming time regarding a transfer sheet.

In order to achieve the above object, the present invention provides an image forming apparatus comprising a first image forming unit incorporating an image formation processing means therein, a sheet supply station for feeding a sheet to the first image forming unit, and a sheet ejecting station for ejecting the sheet on which an image is formed by the first image forming unit out of the image forming apparatus, and wherein a second image forming unit having the same function and size as those of the first image forming unit is mounted within the image forming apparatus and a sheet exit of the second image forming unit is directly connected to the sheet ejecting station.

With this arrangement, since two kinds of images can be formed on the same sheet by passing the sheet through the first and second image forming units continuously, it is possible to form various images on the sheet such as double-surface print, multi-print or the like.

In this case, since the inlet exit of the second image forming unit is directly connected to the sheet ejecting station for ejecting the sheet on which the image is formed by the first image forming unit out of the apparatus, the sheet outcoming from the first image forming unit can be introduced into the second image forming unit for a very short time without passing through an extra or meaningless route, thus shortening the double-surface printing time or multi-printing time regarding the transfer sheet.

As apparent from the above explanation, according to the present invention, since the double-surface print of the multi-print can be effected on the transfer sheet by using the first and second image forming units and the sheet feeding route or path between the first and second image forming units is reduced as long as possible, it is possible to shorten the double-surface printing time or multi-printing time regarding the transfer sheet.

Further, another object of the present invention is to provide an image forming apparatus which can increase a sheet supplying ability and a sheet ejecting ability without providing additional sheet supplying means and sheet ejecting means.

To achieve this object, the present invention provides an image forming apparatus comprising a first sheet supplying means for supplying a sheet from a sheet stack, a first image forming station where an image is formed on the supplied sheet, and an ejecting/stacking means on which the sheets each having the image formed in the first image forming station, and wherein there is a provision of a sheet re-feeding means for directing the sheets stacked on the ejecting/stacking means to a second image forming station different from the first image forming station.

As mentioned above, according to the present invention, since the sheets outcoming from the first image forming station are ejected onto the ejecting/stacking means and the sheets from the ejecting/stacking means are directed to the second image forming station, the following advantages are obtained:

(1) A sheet supplying ability can be increased;

(2) A sheet ejecting ability can be increased by using a face-up sheet ejection fashion;

(3) In the above (2), it is possible to effect the multi-print by ejecting the sheet into a sheet cassette once and then by printing a new image on the sheet again in the second image forming station; and (4) In the above (3), by removing the sheet cassette, a large number of sheets can be ejected on a cassette support without cassette.

The present invention can achieve the above advantages (1) to (4) with an inexpensive, simple and compact construction of the image forming apparatus.

DESCRIPTION OF THE PREFERRED EMBODIMENTS

The present invention will be explained in connection with a laser printer embodying the invention with reference to the accompanying drawings.

First of all, a first embodiment of the present invention will be explained with reference to FIGS. 1 and 2.

Figure 1:
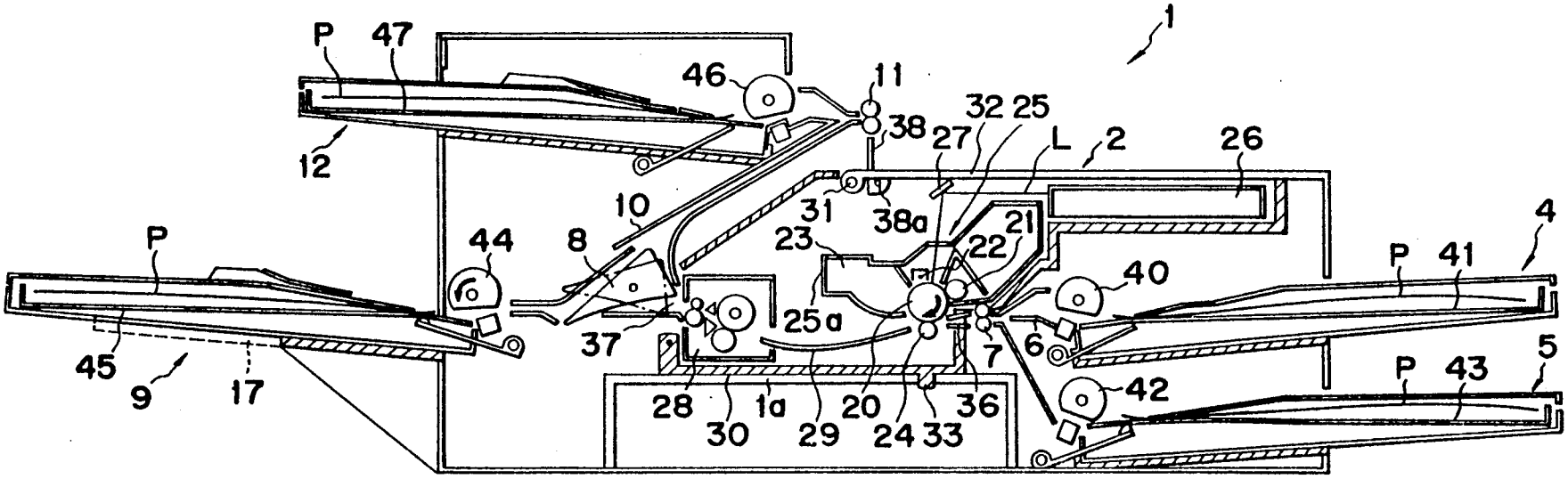
FIG. 1 is an elevational sectional view of an image forming apparatus having a first image forming unit alone, according to a first embodiment of the present invention.

In FIG. 1, the reference numeral 20 denotes a photosensitive drum acting as an image bearing member, around which a developing device 21, a primary charger 22, a cleaning device 23 and a transfer charger 24 are disposed, these elements 20-24 constituting an image formation processing means. An optical unit comprising a laser scanner 26, reflection mirror 27 and the like is arranged at the right (FIG. 1) of the image formation processing means and thereabove, and a fixing means comprising a fixing device 28, a guide 29 for a transfer material (transfer sheet) P and the like is arranged at the left of the image formation processing means.

When image light L from the laser scanner 26 is exposed, through the reflection mirror 27, onto the photosensitive drum 20 primarily charged by the primary charger 22, an electrostatic latent image is formed on the photosensitive drum 20 which is in turn is visualized to form a toner image by developer (toner) in the developing device 21. The toner image is transferred onto the transfer sheet P by the transfer charger 24, which transfer sheet is then fed, through the guide 29, to the fixing device 28, where the toner image is permanently fixed on the sheet by heat and pressure.

The photosensitive drum 20, developing device 21, primary charger 22 and cleaning device 23 are integrally incorporated into a cartridge container 25*a* to form a process cartridge 25 which facilitates the maintenance of the apparatus in such a manner that when the processing device is to be replaced due to the end of its service life or when the consumption goods (for example, the toner) should be replaced the whole process cartridge 25 can be replaced by a new one.

The optical unit such as the laser scanner 26, the image formation processing means such as the process cartridge 25, and the fixing means such as the fixing device 28 are positioned and supported from right upper side toward left lower side (FIG. 1) within a unit frame 30 made of glass-reinforced plastic material, thus constituting a first image forming unit 2. Incidentally, the process cartridge 25 is removable with respect to the unit frame 30. At an upper portion of the unit frame 30, an openable door 32 is mounted through a hinge 31 to facilitate the maintenance of the apparatus, such as the replacement of the process cartridge and/or the jamming treatment. The unit frame 30 is positioned on a base 1*a* of a body 1 of the image forming apparatus so that the first image forming unit 2 is supported on the base 1*a*. Incidentally, the positioning and securing of the unit frame 30 with respect to the base 1*a* are effected by fitting bosses 33 formed on the unit frame 30 into positioning holes formed in the base 1*a*. Accordingly, the first image forming unit 2 is removably mounted within the body 1 of the image forming apparatus.

At the right (FIG. 1) of the first image forming unit 2, register rollers 7 are disposed in the vicinity of the photosensitive drum 20. At the right of the register rollers 7, there are arranged first and second sheet supply units 4 and 5 comprising sheet cassettes 41, 43, supply rollers 40, 42 and the like. A feeding guide 6 for the transfer sheet P is disposed between the first and second sheet supplying units 4, 5 and the register rollers 7. The transfer sheets P having the different size are stacked in the first and second sheet supplying units 4, 5, respectively.

At the left (FIG. 1) of the first image forming unit 2, a flapper 8 is disposed in the vicinity of the fixing device 28, for changing the moving direction of the transfer sheet P. At the left of the flapper 8, there is arranged a third sheet supplying unit 9 comprising a sheet cassette 45, supply roller 44 and the like. A U-shaped transfer sheet conveying guide 10 is disposed to extend rightwardly and upwardly from the flapper 8 toward the upper portion of the first image forming unit 2, which guide serves to change the feeding direction of the transfer sheet P by about 180 degrees so that the feeding direction of the sheet is reversed. Ejector rollers 11 are arranged at the other end (opposite to the flapper 8) of the guide 10. At the left of the ejector rollers 11, there is sheet supplying unit 12 comprising a sheet cassette 47, supply roller 46 and the like. In this way, the transfer sheets P from the third and fourth sheet supplying units 9 and 12 can be directed toward the ejector rollers 11. Incidentally, the sizes of the transfer sheets P stacked in the third and fourth sheet supplying units 9 and 12 may be the same or different.

The ejector rollers 11 can selectively serve as register rollers, and the supply roller 44 of the third sheet supplying unit 9 is selectively reversible to serve as an ejector roller.

Next, an operation of the image forming apparatus will be explained. When the transfer sheet P fed from the sheet cassette 41 or 43 of the first or second sheet supplying unit 4 or 5 through the supply roller 40 or 42 reaches the register rollers 7, the transfer sheet is synchronized in timed relation with the first image forming unit 2 by the register rollers 7; thereafter, the transfer sheet is introduced into the first image forming unit 2 through a sheet inlet opening 36 formed in the unit frame 30, where the image is transferred on an upper surface of the transfer sheet and then the image is fixed on the sheet.

Thereafter, the transfer sheet P is moved out of the first image forming unit 2 through a sheet exit opening 37 formed in the unit frame 30 at the side of the fixing device 28 and is fed toward the flapper 8. When the flapper 8 is positioned in a position shown by a solid line, the transfer sheet P is conveyed toward the third sheet supplying unit 9. In this case, the sheet cassette 45 of the third sheet supplying unit 9 is removed, and a supporting portion for the cassette 45 is extended to form an ejector tray 17, and the supply roller 44 is reversed to act as the ejector roller. In this way, the transfer sheet P is ejected on the ejector tray 17 with the imaged surface turned upside (i.e., face-up condition).

If it is desired that the transfer sheet P is ejected in a face-down condition, the flapper 8 is shifted to a position shown by a phantom line, with the result that the transfer sheet P is ejected on the openable door 32 of the unit frame 30 through the guide 10 and the ejector rollers 11. In this case, by periodically feeding color papers from the fourth sheet supplying unit 12 toward the door 32, it is possible to assort the transfer sheets P stacked in the face-down condition (for example, per JOB).

Incidentally, the reference numeral 38 denotes a regulating plate for regulating the movement of the stacked sheets, which plate can be rotated around a pivot 38*a* and in use is cocked, if necessary.

Figure 2:
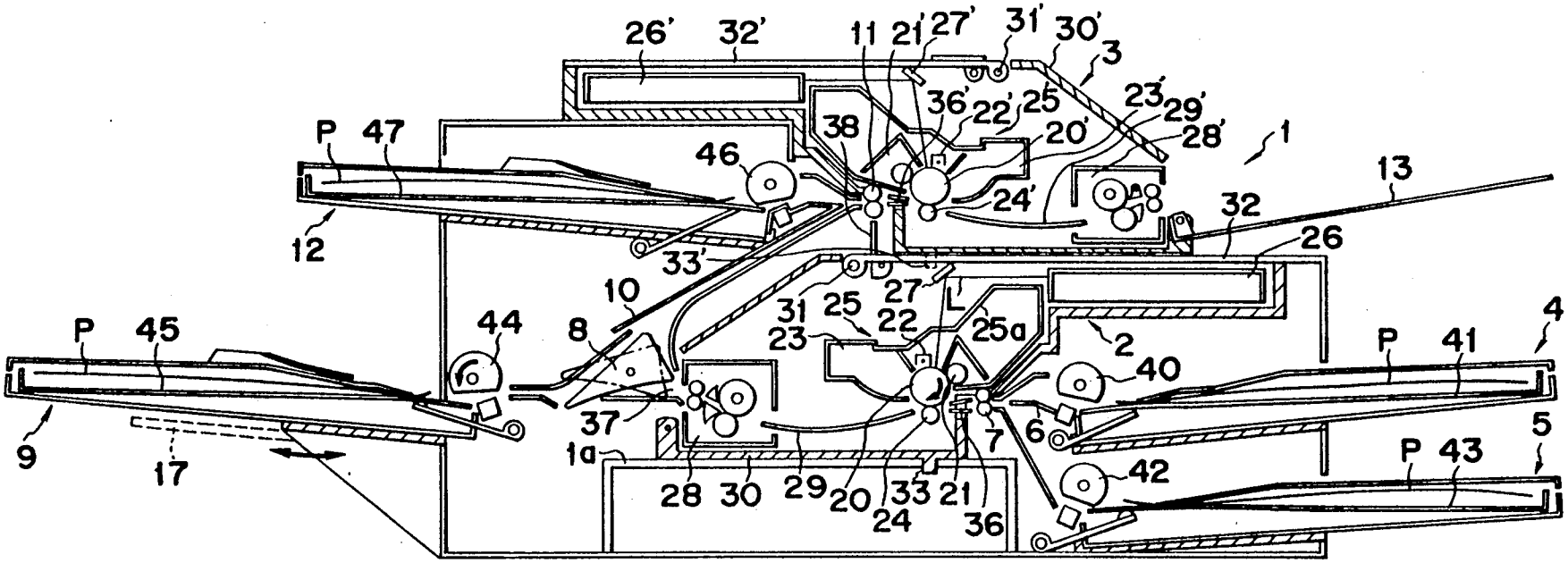
FIG. 2 is an elevational sectional view of the image forming apparatus having both first and second image forming units.

As shown in FIG. 2, on the first image forming unit 2, a second image forming unit 3 having the same function, size and constructural elements as the first image forming unit 2 is positioned and secured. The second image forming unit 3 is disposed in such a manner that the feeding direction of the transfer sheet P in this unit 3 is opposite to the sheet feeding direction in the unit 2 and the sheet inlet opening 36′ is positioned in the vicinity of the ejector rollers 11. The second image forming unit 3 is positioned and secured on the first image forming unit 2 by fitting the bosses 33′ of the unit frame 30′ of the unit 3 into positioning holes formed in the door 32. The second image forming unit 3 is not indispensable to this laser printer but optional. However, by utilizing the second image forming unit 3 together with the first image forming unit 2, it is possible to form various images. Incidentally, the reference numeral 13 denotes an ejector tray.

Next, an operation of the image forming apparatus incorporating the second image forming unit 3 therein will be explained.

First of all, explaining an example that the double-surface print for printing images on both surfaces of the transfer sheet P is performed, when the transfer sheet P fed from the first or second sheet supplying unit 4 or 5 is introduced into the first image forming unit 2 through the register rollers 7, the image is transferred on the upper surface of the transfer sheet and then is fixed on the sheet in the first image forming unit 2; thereafter, by the flapper 8 positioned in the phantom line position, the transfer sheet P is directed toward the ejector rollers 11 through the guide 10, with the image surface turned downside. In this case, since the ejector rollers 11 act as the register rollers, the transfer sheet P is synchronized in timed relation with the second image forming unit 3 by the ejector rollers 11 and is introduced into the second image forming unit 3, where the toner image formed on the photosensitive drum 20′ is transferred onto the other surface of the transfer sheet P through the transfer charger 24′ and the transferred image is fixed to the sheet by the fixing device 28′. Then, the transfer sheet having the images on both surfaces thereof is ejected on the ejector tray 13′ of the second image forming unit 3.

In this case, since the orientation of the laser scanner 26′ of the second image forming unit 3 is opposite to that of the first image forming unit 2, the main scanning direction (writing direction for the image) is also reversed. As a countermeasure to this, for example, the image information for one line or a few pages is first stored in the RAM in the image forming apparatus 1, and then the image information is read out from the reverse direction.

Incidentally, if the image is formed on only one surface of the transfer sheet P, the latter may be merely passed through the second image forming unit 3.

On the other hand, when the multi-print is effected on a single transfer sheet P, for example, the process cartridge 25′ in the second image forming unit 2 may be replaced another one including the toner of color different from the color of the toner in the process cartridge in the first image forming unit 2. And, in this case, the transfer sheet P on the upper surface of which the image is formed in the first image forming unit 2 is once positioned on the sheet cassette 45 of the third sheet supplying unit 9′ through the flapper 8, then, this transfer sheet P is conveyed from the guide 10 toward the ejector rollers 11 through the supply roller 44 of the third sheet supplying unit 9, and, thereafter, the transfer sheet P is synchronized in timed relation with the second image forming unit 3 and is then introduced into the latter, where the different image is superimposed on the image on the transfer sheet which has already formed in the first image forming unit 2.

Incidentally, if the images are formed on the different transfer sheets P by means of the first and second image forming units 2 and 3, the transfer sheet P is fed, by using the first or second sheet supplying unit 4 or 5, to the first image forming unit 2, where the image is formed on the transfer sheet P; then, this transfer sheet P is ejected on the sheet cassette 45 of the third sheet supplying unit 9 by rotating the supply roller 44 of the third sheet supplying unit 9 in the reverse direction. Incidentally, if a large number of transfer sheets P are handled, the sheet cassette 45 is removed so that the transfer sheets P may be ejected and stacked on the ejector tray 17. On the other hand, the transfer sheet P from the fourth sheet supplying unit 12 is fed to the second image forming unit 3 simultaneously with the image formation being effected in the first image forming unit 2; after the image is formed on the transfer sheet P in the second image forming unit 2, the sheet P is ejected onto the ejector tray 13.

As apparent from the above explanation, since the sheet inlet opening 36' of the second image forming unit 3 is directly communicated with the ejector rollers 11 of the image forming apparatus 1, when the double-surface print or the multi-print is effected, the transfer sheet on which the image is formed by the first image forming unit 2 is immediately fed to the second image forming unit 3, thereby shortening the double-surface printing time or the multi-printing time. That is to say, in this image forming apparatus, it is possible to obtain various image (i.e., to effect the double-surface print and the multi-print) and, at the same time, to form the images on the transfer sheets fed from the first and second sheet supplying units 4, 5 and eject the transfer sheet for a very short time during the image formation operation, thus shortening the image forming time.

Further, since the second image forming unit 3 is arranged on the first image forming unit 2, the installation space for the image forming apparatus can be reduced. In addition, since the second image forming unit 3 is disposed in the reverse orientation with respect to the first image forming unit 2 in such a manner that the feeding direction of the transfer sheet P in the unit 3 is opposite to that in the unit 2, the feeding path for the transfer sheet P can be shortened by bending such feeding path (from the sheet exit opening 37 of the first image forming unit 2 to the sheet inlet opening 36' of the second image forming unit 3) in a U-shaped configuration, thus shortening the sheet feeding time, and accordingly, the image forming time.

Figure 3:
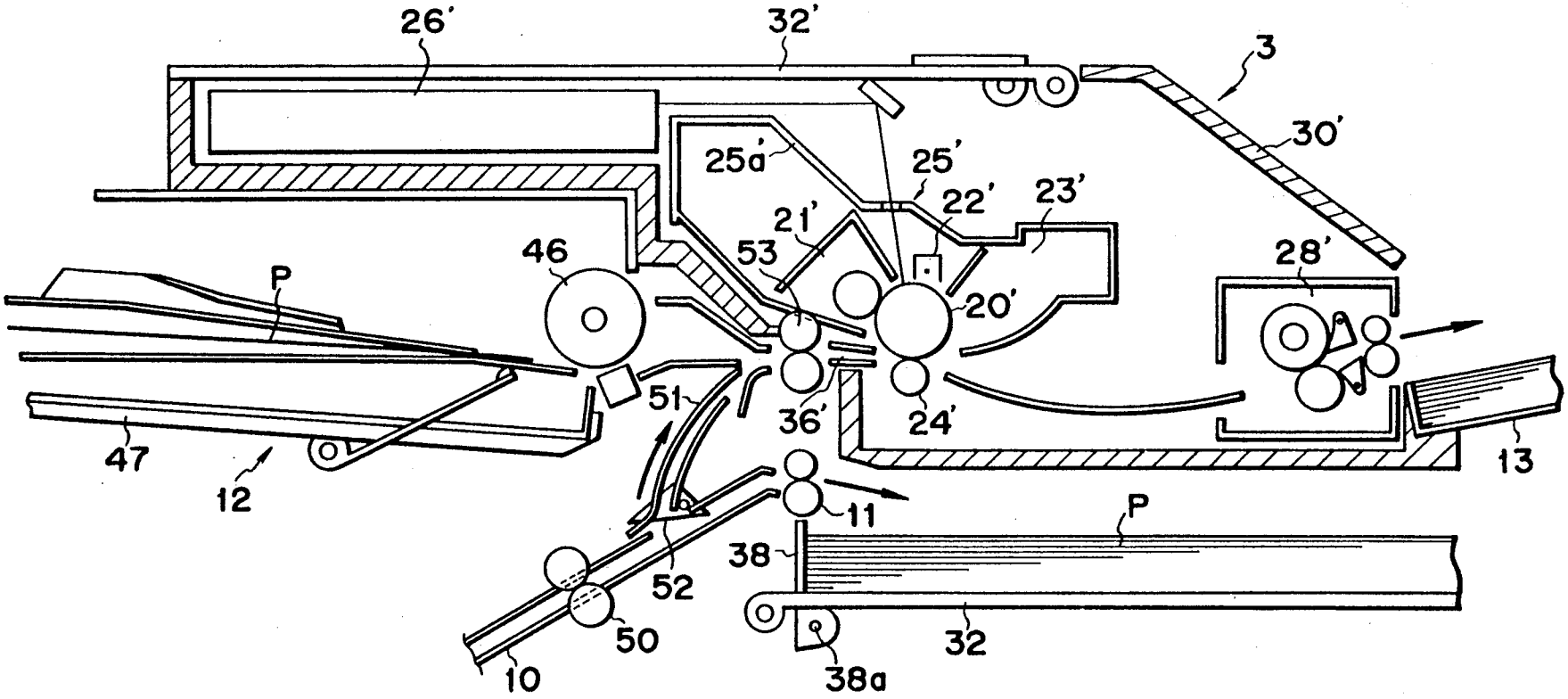
FIG. 3 is an enlarged elevational sectional view mainly showing a second image forming unit of an image forming apparatus according to a second embodiment of the present invention.

Next, a second embodiment of the present invention will be explained with reference to FIG. 3. Incidentally, the same elements having the function as same as those in the first embodiment will be designated by the same reference numerals and the explanation thereof will be omitted.

In the above-mentioned first embodiment, since, when the second image forming unit 3 is attached to the image forming apparatus 1, the transfer sheet P on which the image was formed by the first image forming unit 2 was ejected on the ejector tray 13 always through the second image forming unit 3, if the image formation is not effected in the second image forming unit 3, the image formation time was extended by a time when the transfer sheet passed through the second image forming unit 3. However, in this second embodiment, if the second image forming unit 3 is not used, the transfer sheet P is not introduced into the second image forming unit 3, but is directly ejected on another ejector tray.

More particularly, unlike to the first embodiment, in the second embodiment, the second image forming unit 3 and the fourth sheet supplying unit 12 are disposed in a slightly elevated position, and new register rollers 53 are arranged in front of the sheet inlet opening 36' of the second image forming unit 3, whereby the openable door 32 of the first image forming unit 2 can be used as an ejector tray. And, conveying rollers 50 for the transfer sheet P are arranged in the guide 10 and a branched guide 51 for guiding the transfer sheet P toward the register rollers 53 is disposed at an downstream side of the conveying rollers 50. Further, a flapper 52 is arranged at the intersection between the guide 10 and the branched guide 51 so that the transfer sheet P can be selectively fed toward the ejector rollers 11 or toward the second image forming unit 3 through the register rollers 53.

In this way, when it is desired that a new image is formed on the transfer sheet on which the image has already been formed by the first image forming unit 2 by performing the double-surface print or the multi-print, by controlling the flapper 52, the transfer sheet P is fed toward the register rollers 53 through the branched guide 51 to direct the sheet into the second image forming unit 3 where the new image is formed on the transfer sheet. On the other hand, if it is no need to form the image by the second image forming unit 3, by controlling the flapper 52, the transfer sheet P is directly ejected on the door 32 of the first image forming unit 2 by means of the ejector rollers 11.

Accordingly, when the second image forming unit 3 is not used, since the image forming time regarding the transfer sheet P can be reduced and the transfer sheet is not passed through the second image forming unit 3, the service life of the second image forming unit 3 is extended and the consumption of electric power can be saved. Further, since the feeding path for the transfer sheet P is shortened, the trouble such as the sheet jamming will also be reduced.

When the image is formed on the transfer sheet fed from the fourth sheet supplying unit 12, the transfer sheet P, in the fourth sheet cassette 47 may be fed toward the register rollers 53 by means of the supply roller 46; whereas, when the image is formed on the transfer sheet P fed from the third sheet supplying unit 9, the transfer sheet may be directed toward the register rollers through the branched guide 51. Incidentally, as apparent from the above explanation, in this second embodiment, it is no need that the ejector rollers 11 act as the register rollers.

In the above embodiments, while the invention was explained with reference to the laser printer, the present invention is not limited to the laser printer, but may be applied to an LED printer, ink jet printer or the like. Further, in place of the laser scanners 6, 26' in the optical unit, LED arrays or liquid crystal shutter arrays may be used, and, in place of the photosensitive drums 20, 20' in the image formation processing means, ink jet recording heads and the like may be used.

Next, in order to obtain a greater sheet supplying ability, the sheet supplying unit 9 (which may have the same construction as those of the sheet supplying units 4, 5 disposed at the front part of the apparatus) disposed at the rear part of the apparatus and a sheet separating and supplying mechanism therefor will be explained.

Figure 5:
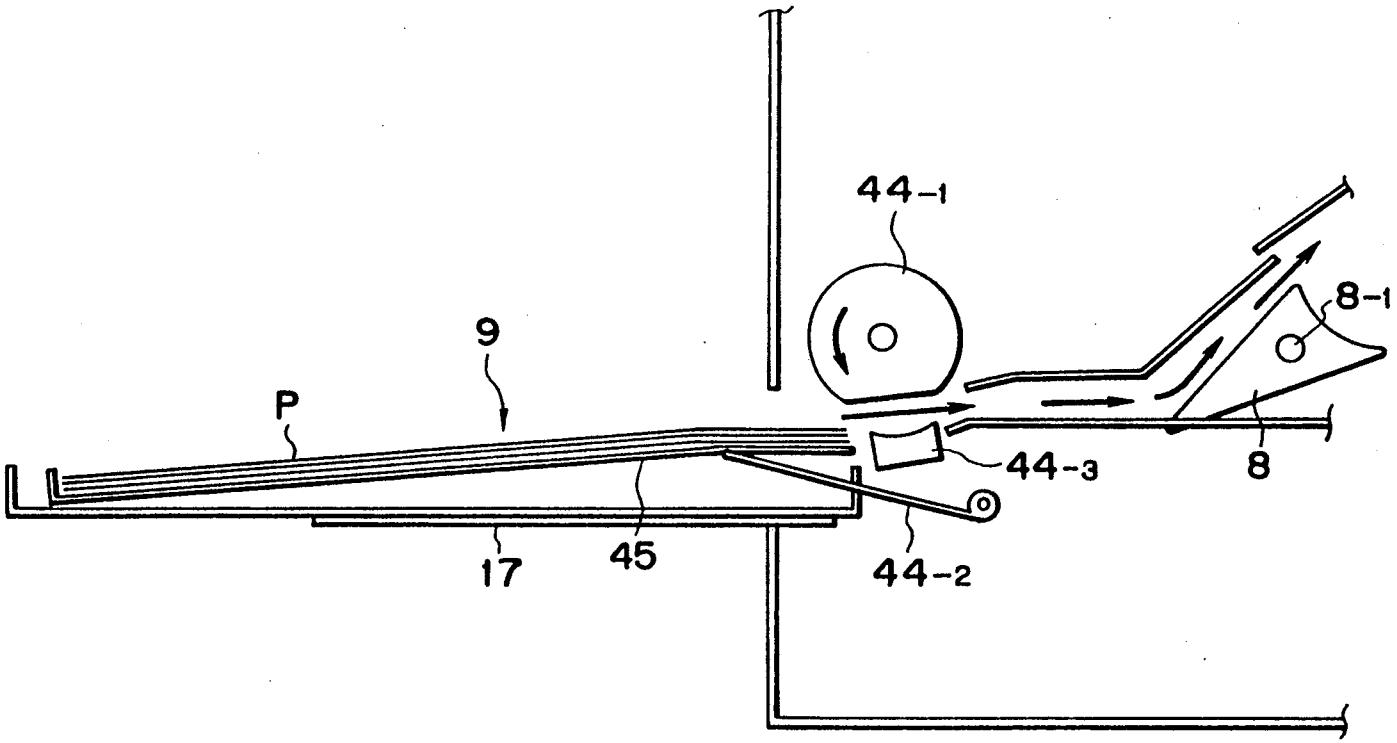
FIG. 5 is an elevational sectional view of a sheet separating and supplying mechanism.

FIG. 5 shows the sheet separating and supplying mechanism. In FIG. 5, the sheet separating and supplying mechanism includes an intermediate plate 45 on which the transfer sheets P are stacked, which intermediate plate 45 has a base portion pivotably supported by a pivot and is set in a predetermined position by a lifter 44-2 biased upwardly by a driving portion (not shown). Similar to the feeding of the sheet from the above-mentioned first sheet supplying unit 4, in the sheet feeding operation regarding the sheet supplying unit 9, the transfer sheet P is separated and fed one by one from the above by rotating a supply/ejector roller 4-1 in a direction shown by the arrow and by the separating action of a separating pad 44-3, and is directed to the flapper 8.

In FIG. 5, the transfer sheet P directed to the flapper 8 reaches the register rollers 11 through the guide 10 and then is introduced into the second image forming unit 3, where the image is formed on the transfer sheet in the same manner as in the first image forming unit 2. Thereafter, the transfer sheet is ejected onto an ejector tray 32 with the imaged surface turned up (i.e., face-up condition or mode).

Next, the case where the ejector tray 32 is filled with the transfer sheets P fed from the sheet supplying unit 4 or 5, or the case where the transfer sheet P is ejected in the face-up condition will be explained.

Figure 4:
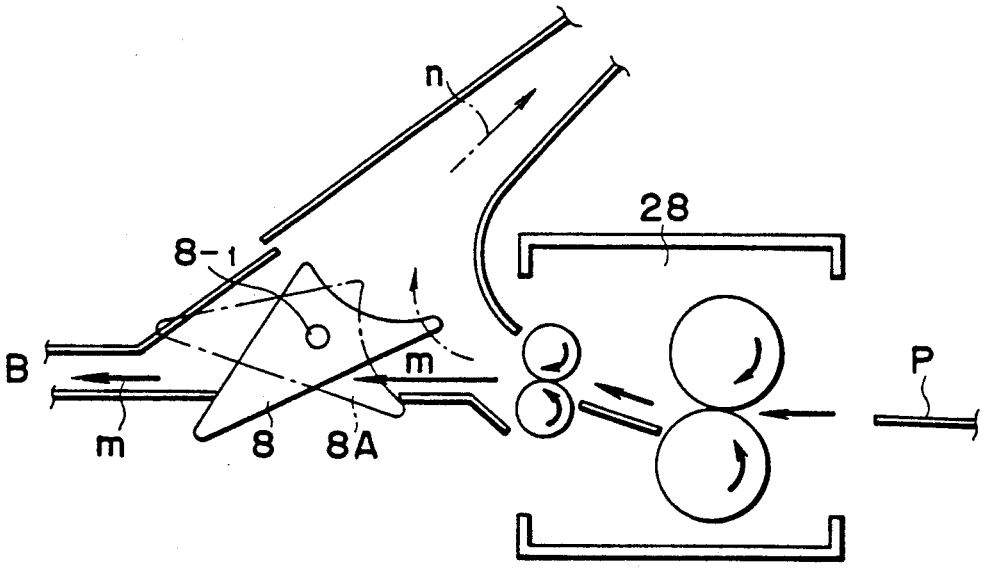
FIG. 4 is a side sectional view of a flapper portion.

As mentioned above, the transfer sheet P fed from the sheet supplying unit 4 or 5 is introduced into the first image forming unit 2 where the image is formed on the transfer sheet and is fixed to the sheet by means of the fixing device 28, and then, the transfer sheet is fed toward the flapper 8. Continuing the explanation again with reference to FIG. 4, the transfer sheet P reached the flapper 8 goes to a direction shown by the arrow m until a leading end of the transfer sheet abuts against the flapper 8.

Now, the flapper 8 normally positioned in the solid line position can freely be rotated in the phantom line position when it is not controlled by a solenoid (not shown). Accordingly, the transfer sheet P abutted against the flapper 8 lifts the flapper 8 due to the stiffness or rigidity of the sheet and is moved toward a position B along the direction m. When a trailing end of the transfer sheet has past through the flapper 8, the latter is returned to the solid line position due to its weight.

In FIG. 5, the transfer sheet P passed through the flapper 8 and moved in the direction m is fed to the supply/ejector roller 44-1. The supply/ejector roller 44-1 can be rotated in either normal or reverse direction by an appropriate motor. Further, the lifter 44-2 provides a space in the sheet supplying unit 9 by lifting the intermediate plate 45 when the transfer sheet is not fed from this sheet supplying unit 9.

When the transfer sheet P is fed to the supply/ejector roller 44-1, the latter is rotated in a reverse direction opposite to the direction shown by the arrow (i.e., a direction opposite to the sheet feeding direction from the sheet supplying unit 9), thereby ejecting the transfer sheet P into the space provided above the intermediate plate 45 in the sheet supplying unit 9.

Since the present invention has the construction as mentioned above, by re-feeding the transfer sheet P from the ejecting/stacking means on which the sheets are ejected and stacked into the second image forming unit independent from the first image forming unit, it is possible to increase sheet supplying ability in the laser beam printer 1, and it is possible to add a new ejector means if necessary, and it is possible increase the sheet ejecting ability with the face-up sheet ejecting mode with a simple construction.

As a further embodiment of the present invention, the transfer sheet P on which the image has been formed in the photosensitive drum 20 can be once ejected in the sheet supplying unit 9, and then, the sheet is fed from this sheet supplying unit to the second image forming unit 3 where the new image is super-imposed on the previously formed image of the transfer sheet P (i.e., it is possible to effect the multi-print).

Figure 6:
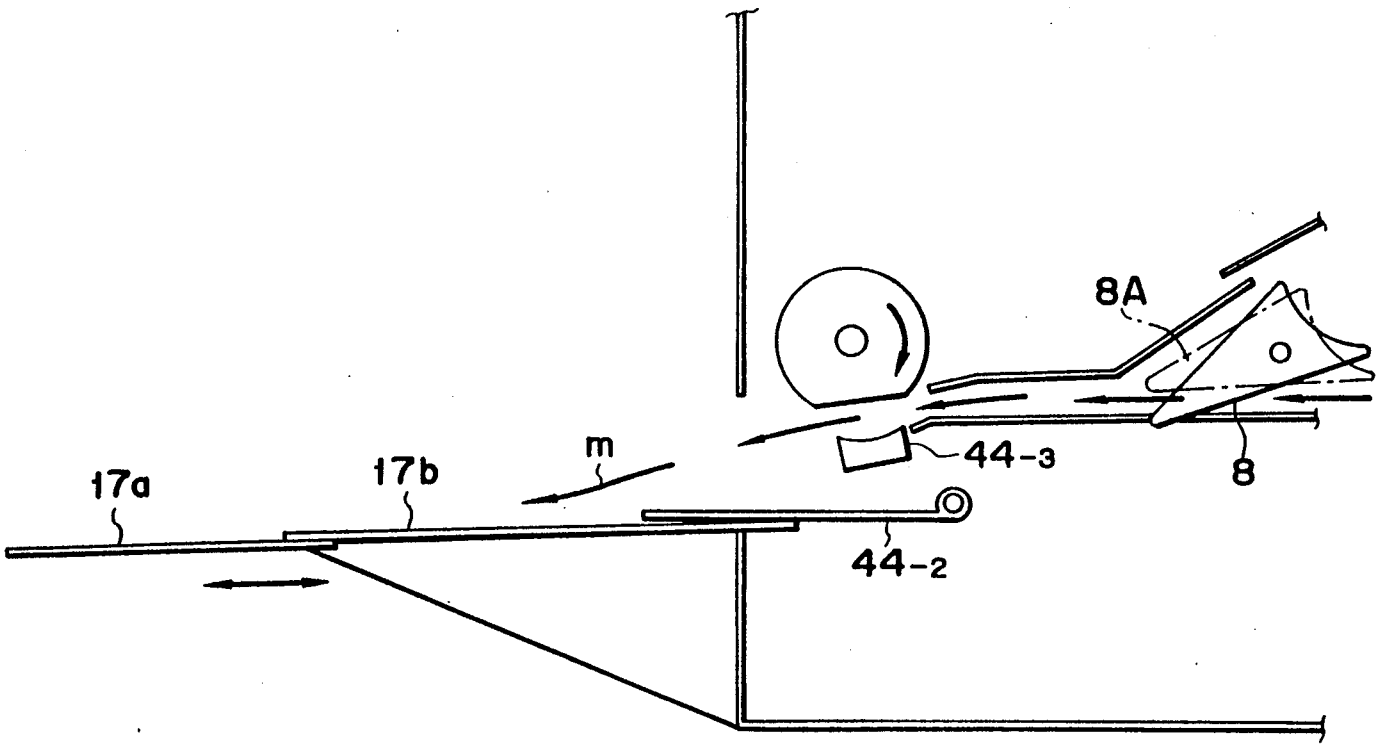
FIG. 6 is an elevational sectional view of a cassette support and an auxiliary tray, showing other embodiment of the present invention.

FIG. 6 shows a further embodiment of the present invention. In FIG. 6, an extensible auxiliary tray **17*c* is disposed on a cassette support 17*b* fixed to the body 1 of the apparatus. By extending the auxiliary tray 17*c* to provide an ejector tray after the sheet supplying unit 9 is removed from the cassette support 17*b***, a further large amount of transfer sheets P can be ejected.

Figure 7:
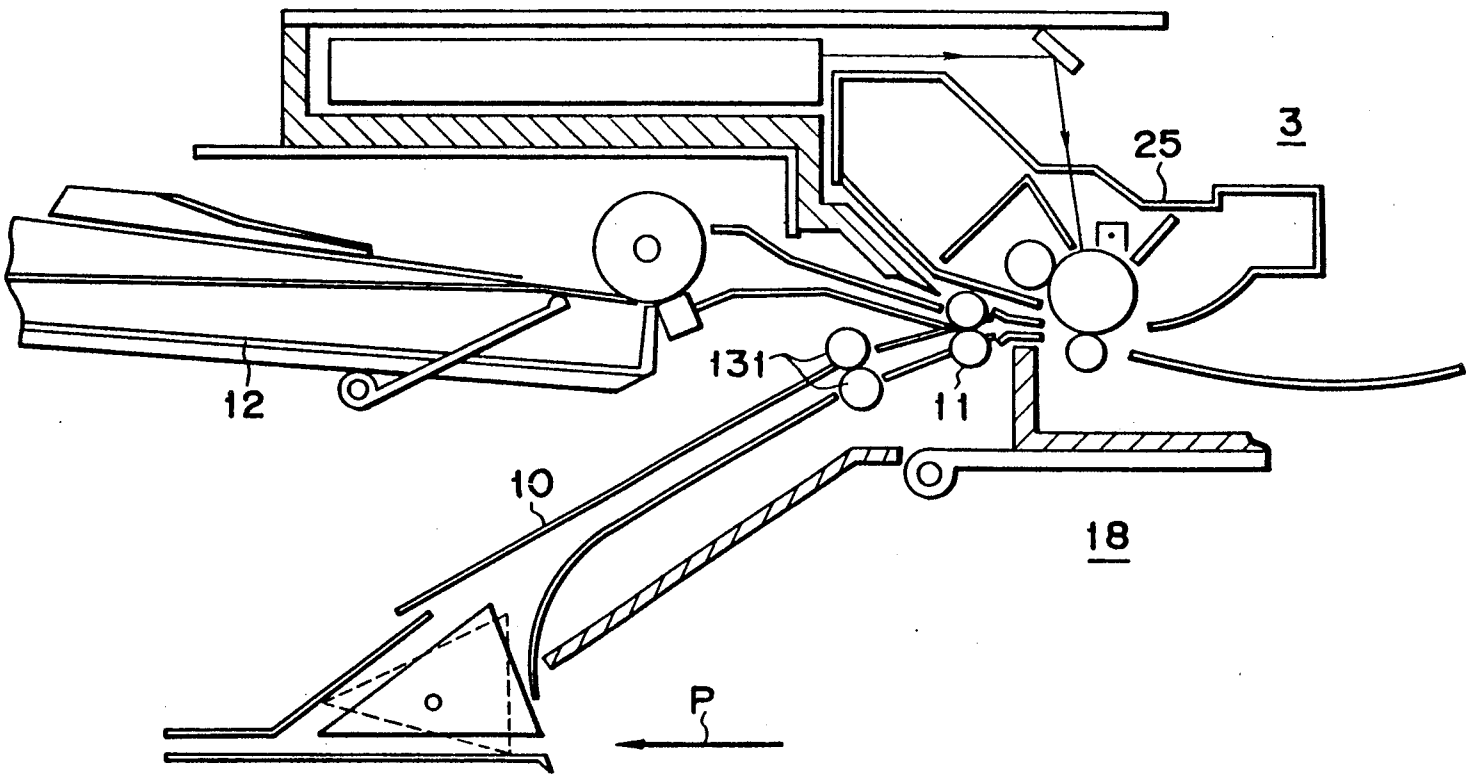
FIG. 7 is a sectional view showing an example that a roller 131 is disposed in front of register rollers 11.

Next, an example that waiting rollers 131 are provided will be explained in connection with FIG. 7.

In this embodiment, waiting rollers 131 acting as a waiting mechanism are arranged at an upstream side of the register rollers 11 of the second image forming unit 3 in the guide 10. With this arrangement, the feeding of the transfer sheet P toward the second image forming unit 3 is temporarily stopped by the waiting rollers 131. The reason for adopting such an arrangement is as follows. That is to say, in the previous embodiments, the transfer sheet P which the image is transferred in the first image forming unit 2 was fed to the second image forming unit 3 immediately. According to such arrangement of the previous embodiment, the memory means of the apparatus must have the capacity which can store the image information for two pages (regarding both surfaces of the sheet).

However, according to this embodiment, since the transfer sheet P on which the image has been formed in the first image forming unit 2 is temporarily waited by the waiting rollers 131 and, meanwhile, the image information regarding the first page can be erased from the memory and the image information regarding the second page can be stored in that memory, the capacity of the memory in the apparatus may be ½ of that of the previous embodiment. Now, if it is assumed that the information from a host computer (not shown) is stored, for example in EP-ROM, although each ROM is expensive, since the contents to be stored is reduced to half in this embodiment, the cost of the printer will be inexpensive.

Further, it is possible to assort the transfer sheets by feeding the color papers from the sheet supplying unit 12 to the ejector tray 13 without printing by the image forming unit 3 between the groups of the transfer sheets ejected from the image forming unit 2 onto the ejector tray 13.

Incidentally, in the above embodiments, while an example that two image forming units are connected to each other was explained, the present invention is not limited to this example, but three, four or more image forming units connected to each other may be used. Further, the present invention is applicable various image forming apparatuses such as LED printers, ink jet printers, copying machines, word processors and the like, other than the laser printer.

Since the embodiment (FIG. 7) of the present invention has the construction as mentioned above, it is possible to add the image forming unit or units depending upon the functions to be requested, and it is possible to use each of the image forming units incorporated into the image forming apparatus as a single-surface recording printer, respectively. Accordingly, when each image forming unit is used independently, a plurality of single-surface prints can be effected in parallel simultaneously, thus shortening the single-surface printing time considerably. Thus, it is possible to increase the number of prints per a unit time.

Further, since each of the image forming units constituting the image forming apparatus can be used independently, even when the offering treatment is required or one of the image forming units is damaged, the printer operation can be continued by using other image forming units, thus reducing the down-time. Further, by temporarily stopping the feeding of the transfer sheet from the upstream side to the downstream side by means of the waiting mechanism, it is possible to feed the transfer sheet in timed relation to the treatment of the image forming unit disposed at the downstream side, thus controlling the feeding timing of the transfer sheet.

By using the first and second image forming units 2 and 3, the image forming apparatus can effect the double-surface print and the multi-print and permits the two simultaneous single-surface printing operations. Next, the resolution of the image formed by the image forming apparatus will be explained.

The resolution of the image varies in accordance with the ability of the laser scanners 26, 26'. That is to say, when the exposure on the photosensitive drums 20, 20' by means of the laser scanners 26, 26' is effected slowly and finely, since the image having the distinct detailed portions is formed, the resolving power of the image forming apparatus increasing; whereas, when the exposure is effected swiftly and roughly, since the image having the indistinct portions is formed, the resolving power is reduced. Among various originals, with respect to the image such as the photograph, high resolving power (for example, 600 dpi or thereabout) is required in the image forming apparatus; whereas, with respect to the normal image such as the character, low resolving power (for example, 300 dpi or thereabout) is sufficient.

In most of the normal image forming apparatuses, the resolving power thereof is constant or two resolving powers can be selectively changed. In this case, for example, if the image of the original includes both the character portion and the photograph portion, there arises a problem that, if the image forming apparatus having the high resolving power is used, the image forming time is increased, whereas, if the image forming apparatus having the low resolving power is used, the sharp or distinct photograph portion of the image cannot be obtained.

In the present invention, by appropriately selecting the laser scanners 26, 26' of the first and second image forming units 2 and 3, if the image of the original includes both the character portion and the photograph portion, it is possible to form the image distinctly and swiftly. More details will be described hereinafter.

First of all, when the resolution of the image formed in the first image forming unit 2 is set to have a value of, for example, 300 dpi, even if the original includes an image portion (photograph) requiring the high resolving power of the apparatus and an image portion (character and the like) requiring the normal resolving power of the apparatus, the image of such original can easily be reproduced by forming the image portion requiring the normal resolving power (character) on the transfer sheet P fed from the first or second sheet supplying unit 4 or 5 by means of the first image forming unit 2 and then by superimposing the image portion requiring the high resolving power (photograph) on the previously formed image portion on the same transfer sheet by means of the second image forming unit 3 and by ejecting such transfer sheet onto the ejector tray 13. In this way, even when the image of the original includes a plurality of (two, in the illustrated embodiment) image portions having different resolutions, such image can be formed on the transfer sheet distinctly and swiftly by the image forming apparatus.

Also in this case, if two original have the images requiring the different resolving powers of the apparatus, such images can be formed simultaneously by the first and second image forming units 2 and 3. That is to say, the image merely requiring the normal resolving power is formed on the transfer sheet P fed from the first or second sheet supplying unit 4 or 5 by means of the first image forming unit 2 and then this transfer sheet is ejected onto the ejector tray 17, and, at the same time, the image requiring the high resolving power is formed on the different transfer sheet P fed from the sheet supplying unit 12 by means of the second image forming unit 3 and then this sheet is ejected onto the ejector tray 13. Of course, it is possible to form the image having the desired resolution by using either one of the first and second image forming units 2 and 3.

Further, when the resolving power of the first image forming unit 2 is set to have a value of, for example, 300 dpi and the resolving power of the second image forming unit 3 can be changed, for example, between 400 dpi and 600 dpi, if the image of the original includes the character portion (requiring 300 dpi) and an image portion requiring the resolution (400 dpi) lower than that of the photograph portion but higher than that of the character portion, the character portion requiring the resolution of 300 dpi is formed by the first image forming unit 2, and the image portion requiring the resolution of 400 dpi is formed by the second image forming unit 3. In this way, any image can be formed swiftly and distinctly by the image forming apparatus, in response to the resolutions required in the original.

Incidentally, in the above embodiments, while an example that two image forming units are incorporated into the image forming apparatus 1 was explained, the present invention is not limited to this example, but may utilize three, four or more image forming units to form the image requiring more complex resolutions at a time.

As apparent from the aforementioned explanation, according to this embodiment, since a plurality of image forming units provide at least two resolving powers, the image can be formed with the plural resolving powers at a time, thus shortening the image forming time and preventing the deviation of the image.

Next, a driving force transmitting mechanism regarding the first and second image forming units, 2, 3 which are the main portions of the image forming apparatus according to the present invention will be explained with reference to FIGS. 8 to 11.

Figure 9:
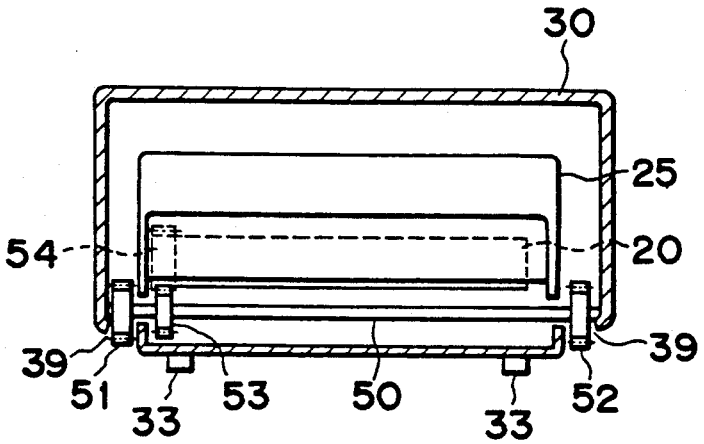
FIG. 9 is a sectional view of the first image forming unit of the image forming apparatus.

Explaining the first image forming unit 2 as an example, as shown in FIG. 9, below the photosensitive drum 20 of the process cartridge 25, a rotary shaft 50 extends along the photosensitive drum 20 and is rotatably supported by the lower portion of the unit frame 30. First and second drive input gears 51 and 52 fixed to the respective end portions of the rotary shaft 50 protrude from openings 39 in a left and right symmetrical fashion to be exposed to outside, which openings 39 are formed in the bottom portion of the unit frame 39 and are disposed on both sides of the sheet feeding path. A drum gear 54 for rotating the photosensitive drum 20 is meshed with a gear 53 fixed to the rotary shaft 50 near the first drive input gear 51, so that the photosensitive drum 20 is rotated through the gear 53 and the drum gear 54 when the rotary shaft 50 is rotated. Incidentally, various rotatable elements in the process cartridge 25 are also rotated by the rotation of the rotary shaft 50.

Figure 8:
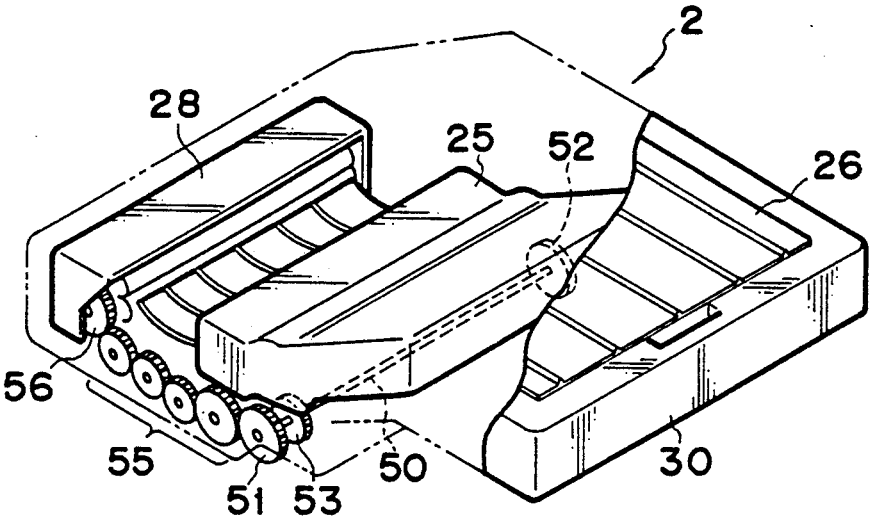
FIG. 8 is a perspective view, with section in part, of the first image forming unit of the image forming apparatus.

Further, as shown in FIG. 8, since the first drive input gear 51 is connected to a fixing gear 56 for driving the fixing device 28 through a gear train 55, when a rotational driving force is inputted from the image forming apparatus 1 to the first or second drive input gear 51 or 52, the photosensitive drum 20 and the like in the process cartridge 25 is driven through the idler gear 53, and at the same time, the fixing device 28 is driven through the gear train 55.

Figure 10:
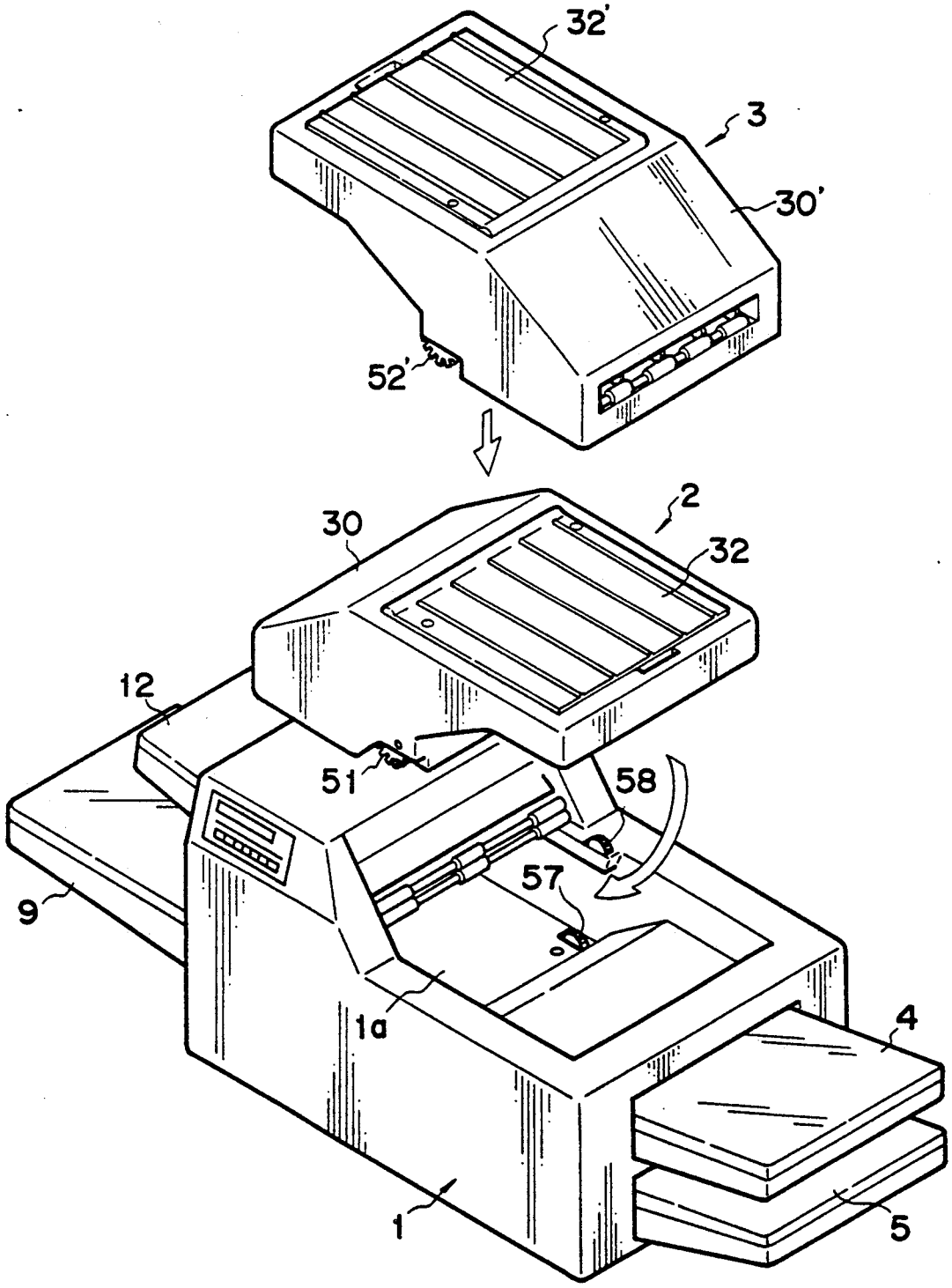
FIG. 10 is a perspective view showing a condition that the first and second image forming units are to be mounted on the image forming apparatus.

On the other hand, as shown in FIG. 10, in the image forming apparatus 1, first and second drive gears 57 and 58 for driving the first and second image forming units 2 and 3, respectively, are disposed at one side of the sheet feeding path. The upper portions of these drive gears 57, 58 protrude outwardly, so that these gears are meshed the first and second image forming units 2, 3 when these units are mounted on the image forming apparatus 1.

When the first image forming unit 2 is mounted on the image forming apparatus 1, the second drive input gear 52 thereof is meshed with the first drive gear 57 of the image forming apparatus 1, whereas, when the second image forming unit 3 is mounted on the image forming apparatus 1, the first drive input gear 51' is meshed with the second drive gear 58 of the image forming apparatus 1, so that the rotatable elements in the first and second image forming units 2, 3 are rotatingly driven by a main motor (not shown) in the image forming apparatus 1.

As mentioned above, since the driving force can be inputted to the first and second image forming units 2, 3 from either left or right side of the transfer sheet P feeding path, if the first and second image forming units 2, 3 are installed in the image forming apparatus 1 in the opposite orientations, the driving force inputting means (first and second drive gears 57, 58) for transmitting the driving force from the image forming apparatus 1 to the first and second image forming units 2, 3 can be arranged only at one side of the image forming apparatus 1. Accordingly, the driving force transmitting path from the main motor (not shown) to the first and second drive gears 57, 58 can be simplified within complexity.

Figure 11:
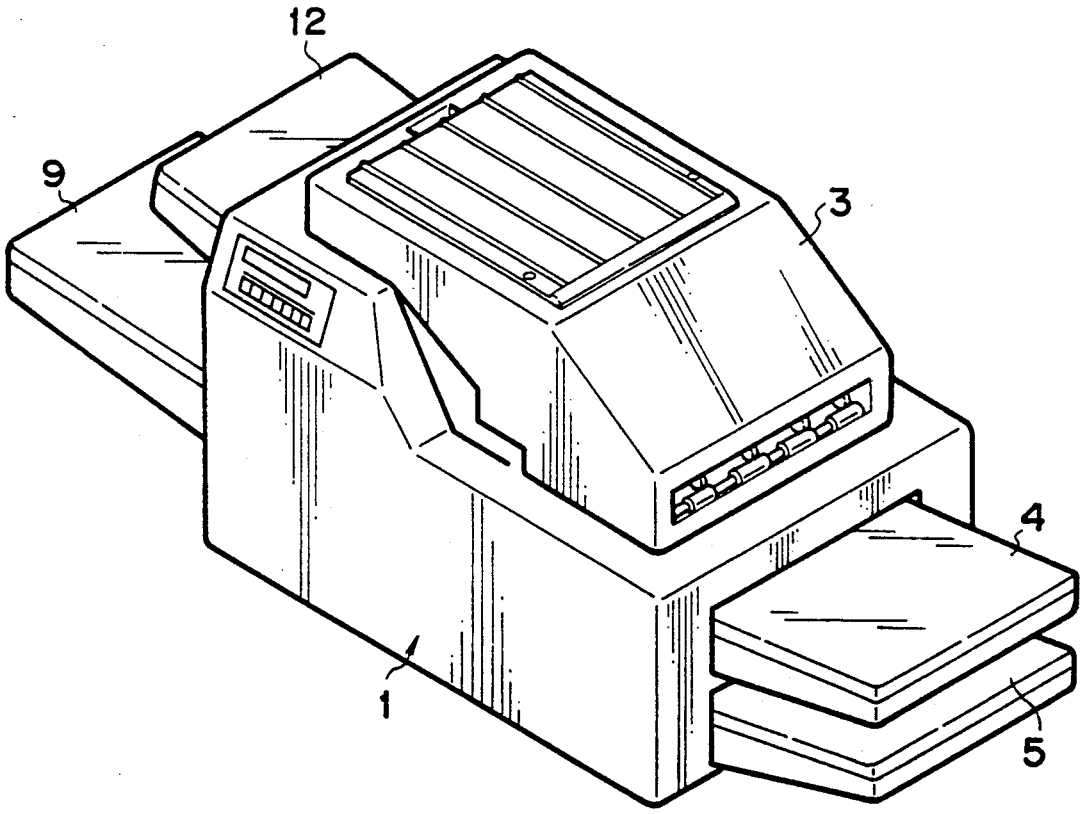
FIG. 11 is a perspective view of the image forming apparatus after the first and second image forming units are mounted thereon.

Incidentally, FIG. 11 shows a condition that the first and second image forming units 2 and 3 are completely incorporated into the image forming apparatus 1.

Next, a driving force transmitting mechanism according to a second embodiment will be explained with reference to FIGS. 12 to 15. Incidentally, the elements having the same function as those of the previous embodiment are designated by the same reference numerals and the explanation thereof will be omitted.

Figure 12:
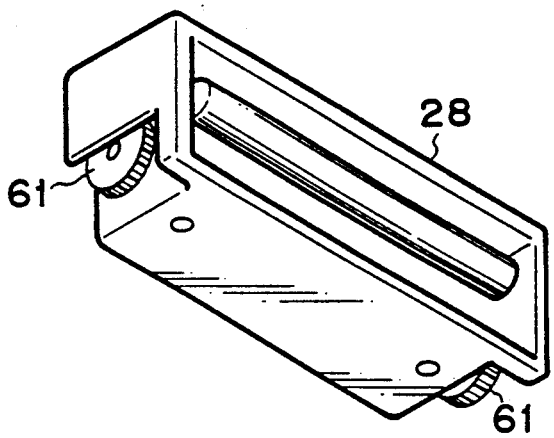
FIG. 12 is a perspective view of a fixing device of the first image forming unit of the image forming apparatus according to the second embodiment of the present invention.
Figure 13:
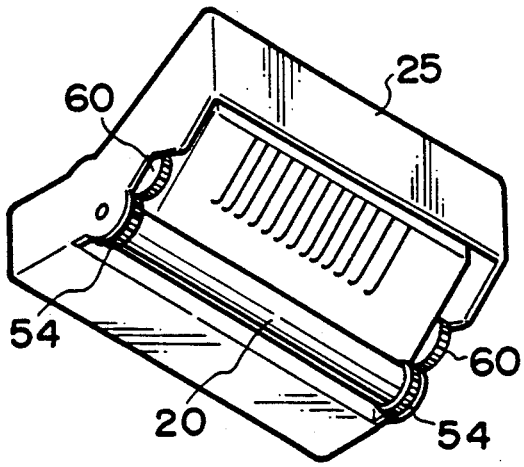
FIG. 13 is a perspective view of a process cartridge of the first image forming unit of the image forming apparatus.
Figure 14:
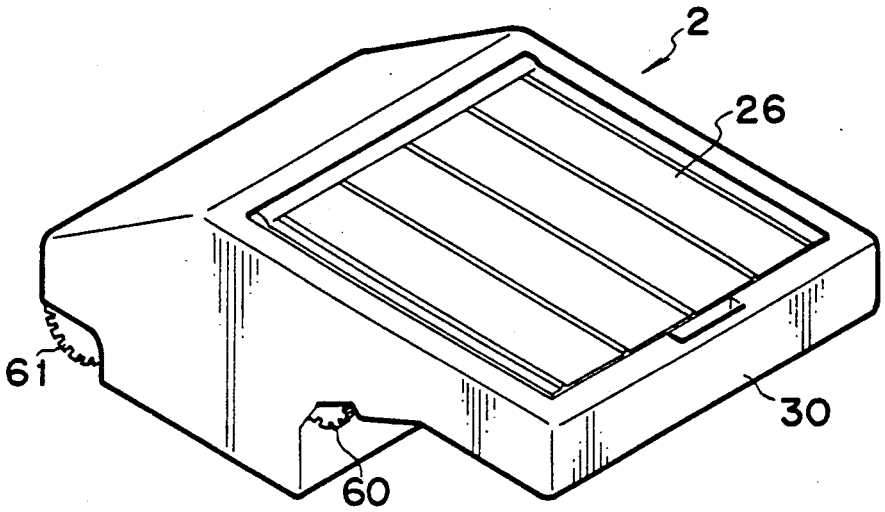
FIG. 14 is a perspective view of the first image forming unit of the image forming apparatus of FIG. 13.
Figure 15:
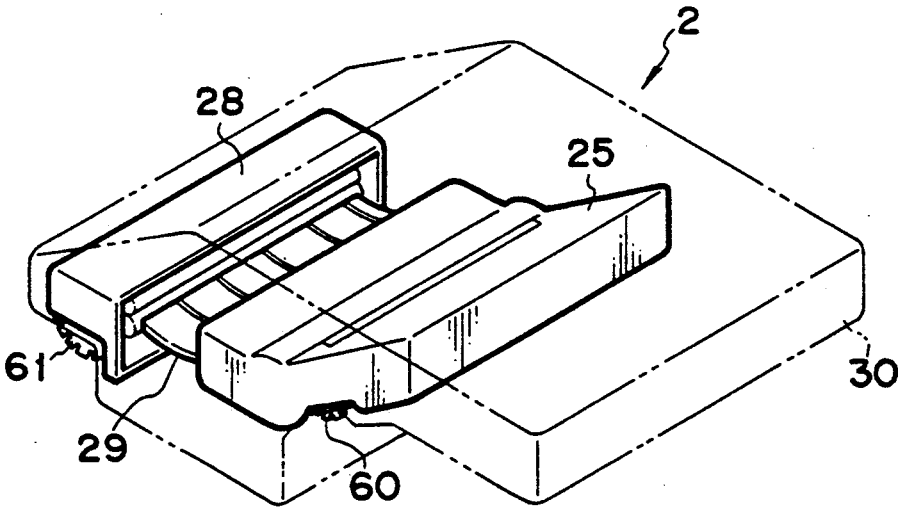
FIG. 15 is a perspective view showing the details of the first image forming unit of the image forming apparatus of FIG. 13.

In the previous first embodiment, while the input from the image forming apparatus 1 to the first and second image forming units 2, 3 was effected at one position regarding the process cartridge 25, and particularly, the transmission of the driving force to the fixing device 28 was effected by utilizing the gear train 55 in the first and second image forming units 2, 3, in this second embodiment, the transmission of the driving force to the process cartridge 25 (photosensitive drum 20 and the like) and the transmission of the driving force to the fixing device 28 are independently effected from the image forming apparatus 1, so that the first and second image forming units 2, 3 are simplified as long as possible More particularly, explaining the first image forming unit 2 as an example, as shown in FIG. 12, the fixing device 28 is provided with fixing device inputting gears 61 which can rotatingly drive the fixing device 28 through the fixing gears 56 at either side of the transfer sheet P feeding path in the fixing device 28; whereas, as shown in FIG. 13, the process cartridge 25 is provided with cartridge inputting gears 60 which can be meshed with the left and right drum gears 54 of the photosensitive drum 20 disposed on both sides of the transfer sheet P feeding path. These fixing device inputting gears 61 and the cartridge inputting gears 60 are protruded outwardly from openings formed in the bottom of the unit frame 30, as shown in FIGS. 14 and 15.

Even when the first and second image forming units 2, 3 are mounted on the image forming apparatus 1 in the opposite orientations, since the transmission of the driving force from the image forming apparatus 1 to the fixing devices 28, 28' of the first and second image forming units 2, 3 and to the rotatable elements (for o example, photosensitive drums 20, 20' and the like) in the process cartridges 25, 25' can be effected only at one side of the apparatus 1, the driving force transmitting path from the main motor (not shown) to the first and second image forming units 2, 3 can be simplified.

Now, in the above first and second embodiments, while an example that the transmission of the driving force to the first and second image forming units is derived from the image forming apparatus 1 was explained, respectively, the present invention is not limited to this example; for example, the driving force may be transmitted from the image forming apparatus 1 to the first image forming unit 2 by the similar means as mentioned above, but the transmission of the driving force to the second image forming unit 3 may be effected through the first image forming unit 2.

According to the embodiments shown in FIGS. 8 to 15, even when the two identical image forming units are mounted on the image forming apparatus in the opposite orientations so that the sheet feeding direction in the first image forming unit is opposite to that in the second image forming unit, since the input portions for the image forming units are disposed on both sides of the sheet feeding path in the image forming unit, the driving force transmitting means for transmitting the driving force from the image forming apparatus to these image forming units can be disposed only at one side of the sheet feeding path in the image forming apparatus 1. Accordingly, the driving force transmitting path in the image forming apparatus can be simplified.

Figure 16:
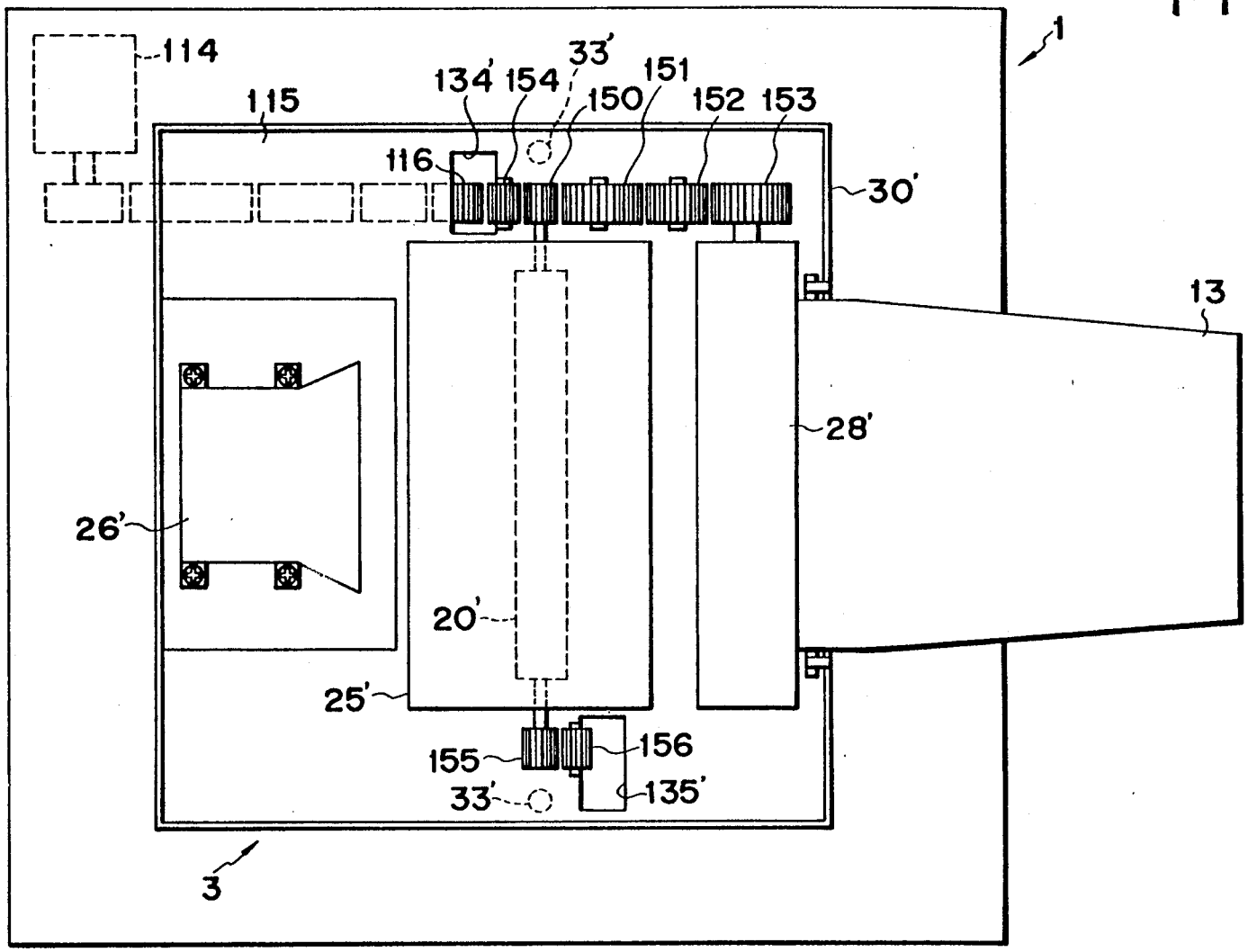
FIG. 16 is a plan view of a driving force transmitting mechanism of an image forming apparatus according to a third embodiment of the present invention.

Next, a driving force transmitting mechanism to the first and second image forming units 2, 3 according to a third embodiment will be explained with reference to FIG. 16. FIG. 16 is a plan view of the image forming apparatus 1 incorporating the second image forming unit 3 thereon. In this arrangement, a drum gear 150 (for driving the photosensitive drum 20') protruding outwardly from the process cartridge 25' of the second image forming unit 3 is connected to a drive gear 153 for driving the fixing device 28' through two idler gears 151, 152, so that the drive gear 153 is rotated by the rotation of the drum gear 150. Further, the driving force from a main motor 114 arranged at a corner of the image forming apparatus 1 is transmitted to the drum gear 150 through a gear train 150 extending from the position below the scanner unit 26' of the second image forming unit 3 toward the register rollers 11 and an idler gear 154 meshed with a last gear 116 of the gear train 115 and meshed with the drum gear 150 through an opening 134' formed in the unit frame 30'.

Further, the transmission of the driving force from the main motor 114 to the first image forming unit 2 is effected through another gear train so that the rotational force of the main motor 114 is transmitted near the register rollers 7. In this case, a last gear in this another gear train is meshed with an idler gear (corresponding to 156 in FIG. 16) which is in turn meshed with a drum gear (corresponding to 155 in FIG. 16) of the photosensitive drum 20 through an opening (corresponding to 135' in FIG. 16) formed in the unit frame 30, a similar in the case of the second image forming unit 3. Incidentally, the transmission of the driving force from the drum gear of the first image forming unit 2 to the drive gear of the fixing device 28 is the same as in the case of the second image forming unit 3.

Further, explaining the power supply to the first and second image forming units 2, 3, an AC input portion for supplying an AC voltage, a low voltage source for supplying a DC voltage to each unit in the image forming apparatus 1, a high voltage transformer portion for supplying a high voltage mainly to the primary carriers 22, 22', developing devices 21, 21' and the like in the process cartridges 25, 25', and a DC controller having a CPU for controlling each unit are all arranged in the image forming apparatus 1. When the first and second image forming units 2, 3 are mounted on the image forming apparatus, these units are connected to these power source portions through terminals. The reason why these power source units are arranged in the image forming apparatus is that the second image forming unit 3 which mainly used as a option makes inexpensive as long as possible.

That is to say, the first and second image forming units 2 and 3 can be used as a completely independent image forming means, respectively. Particularly, in the normal image forming apparatus capable of effecting the double-surface print or multi-print, if any portion of the apparatus is failed or damaged, the printing operation cannot be performed at all. To the contrary, in the image forming apparatus according to the present invention, even if one of the first and second image forming units 2, 3 is damaged, the printing operation can be continued by using the other image forming unit.

Next, a further embodiment of the present invention, wherein the first and second image forming units 2, 3 are arranged side by side will be explained with reference to FIGS. 17 to 20. Incidentally, the elements having the same function as those in the previous embodiment are designated by the same reference numerals and the explanation thereof will be omitted.

In the image forming apparatus according to this embodiment, when only the first image forming unit 2 is mounted on the image forming apparatus 1 on which both of the first and second image forming units can be mounted, the space for accommodating the second image forming unit 3 is effectively utilized.

Figure 17:
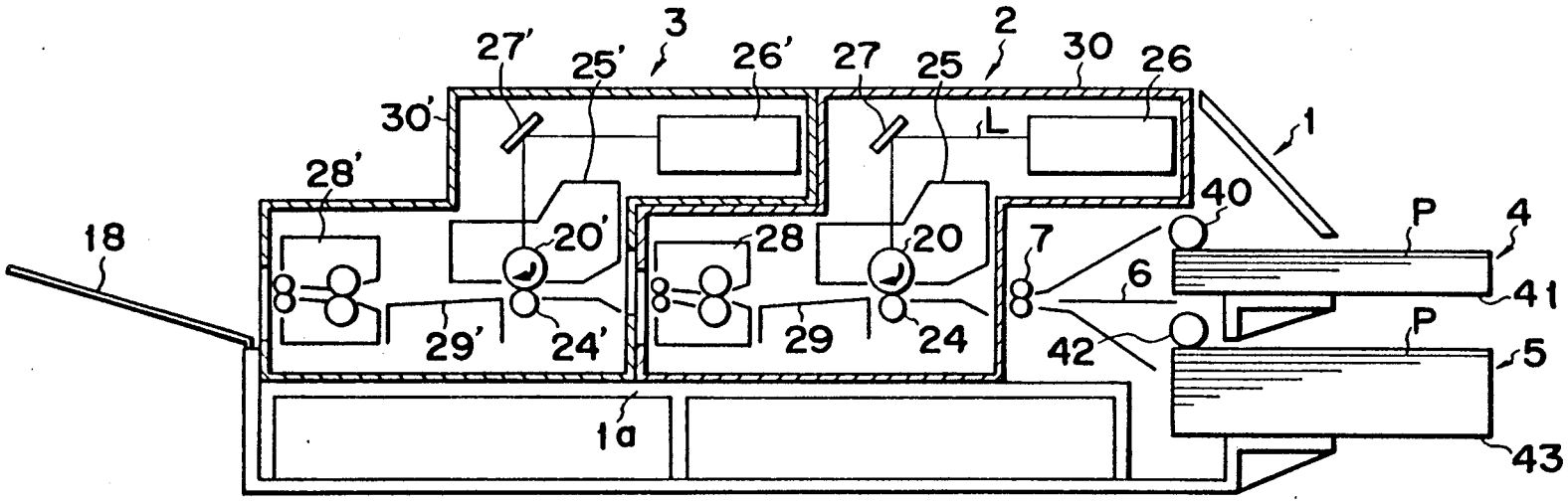
FIG. 17 is an elevational sectional view of an image forming apparatus, showing a condition that various parts are arranged side by side.

First of all, in FIG. 17, the two first and second identical image forming units 2, 3 having the same function, internal construction and size and each having a unit frame 30 (30') including a laser scanner 26 (26') process cartridge 25 (25'), fixing device 28 (28') and the like therein are disposed on the base 1*a* of the image forming apparatus 1 in series, in such a manner that the transfer sheet P from the first or second sheet supplying unit 4 or 5 can be fed to the first and second image forming units 2, 3 through the feeding guide 6 and the register rollers 7 and the multi-print can be effected in the image forming units. In this case, a frame portion of the unit frame 30 of the first image forming unit 2 above the fixing device 28 is closely contacted with a frame portion of the unit frame 30' of the second image forming unit 3 below the laser scanner 26' to save the space. Incidentally, the reference numeral 18 denotes an ejector tray.

Figure 18:
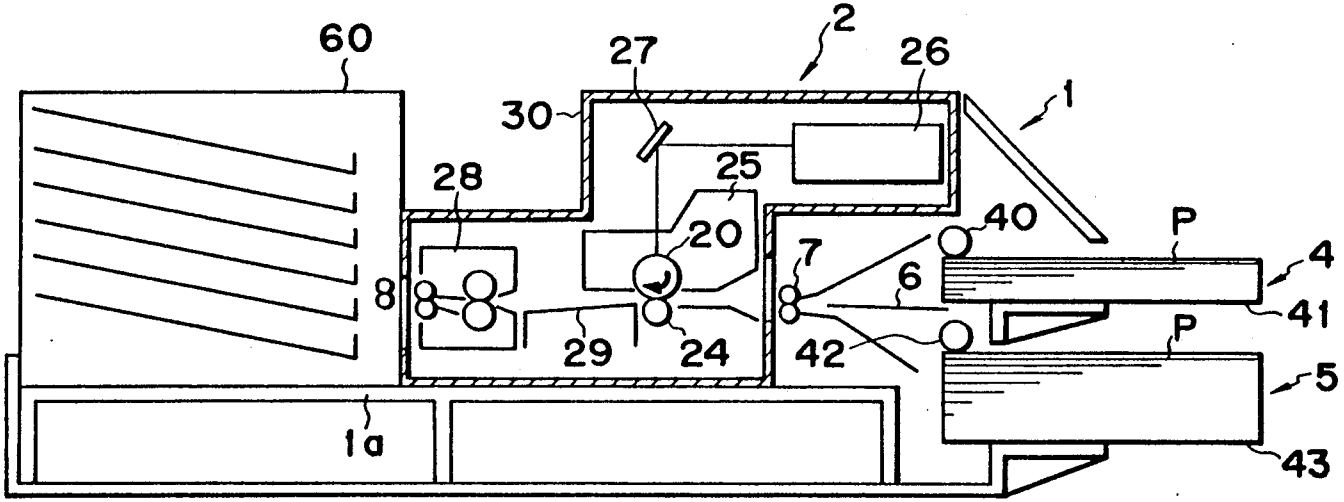
FIG. 18 is an elevational sectional view of an image forming apparatus, showing a condition that a sorter is provided in place of a second image forming unit.

In FIG. 18, when the second image forming unit 3 is not mounted on the image forming apparatus, a sorter 60 for assorting the transfer sheets on which the images are formed is arranged in place of the second image forming unit. In this case, the transfer sheets P on which the images are formed in the first image forming unit 2 are assorted within the sorter 60. Incidentally, in place of the sorter 60, a stacker having the larger sheet collecting ability may be arranged.

Figure 19:
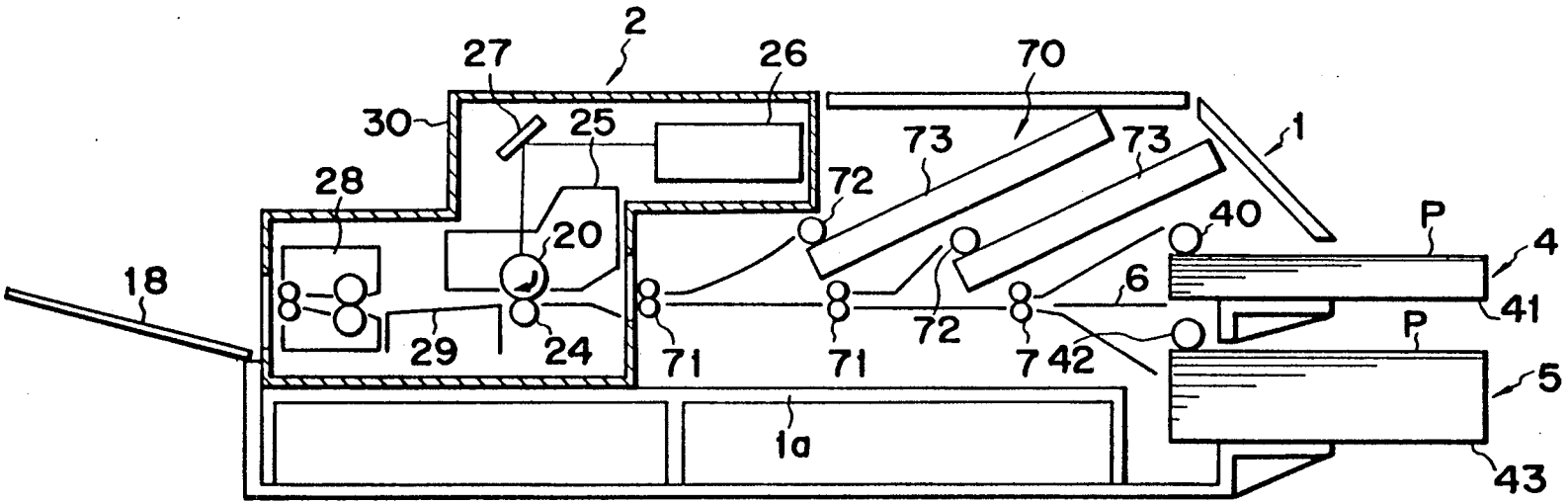
FIG. 19 is an elevational sectional view of an image forming apparatus, showing a condition that a multilayer sheet supplying units are provided in place of a second image forming unit.

Further, in FIG. 19, the first image forming unit 2 is mounted on the image forming apparatus in a position where the second image forming unit is to be positioned (of course, in this case, the second image forming unit is not mounted on the apparatus). In this case, a multi-stage sheet supplying unit 70 comprising two sets of register rollers 71, supply rollers 72 and sheet cassettes 73 is arranged in a space for accommodating the first image forming unit. In this way, various transfer sheets having different sizes can be fed not only from the first and second sheet supplying units 4, 5 but also from the multi-stage sheet supplying unit 70 to the first image forming unit 2 to form the image thereon.

As mentioned above, according to these embodiments, when only the first image forming unit 2 is mounted on the image forming apparatus 1, the remaining space is effectively utilized to arrange the sorter 60 or the multi-stage sheet supplying unit 70, and if necessary, the second image forming unit 3 can be mounted in place of the sorter or the multi-stage sheet supplying unit to form various images.

Figure 20:
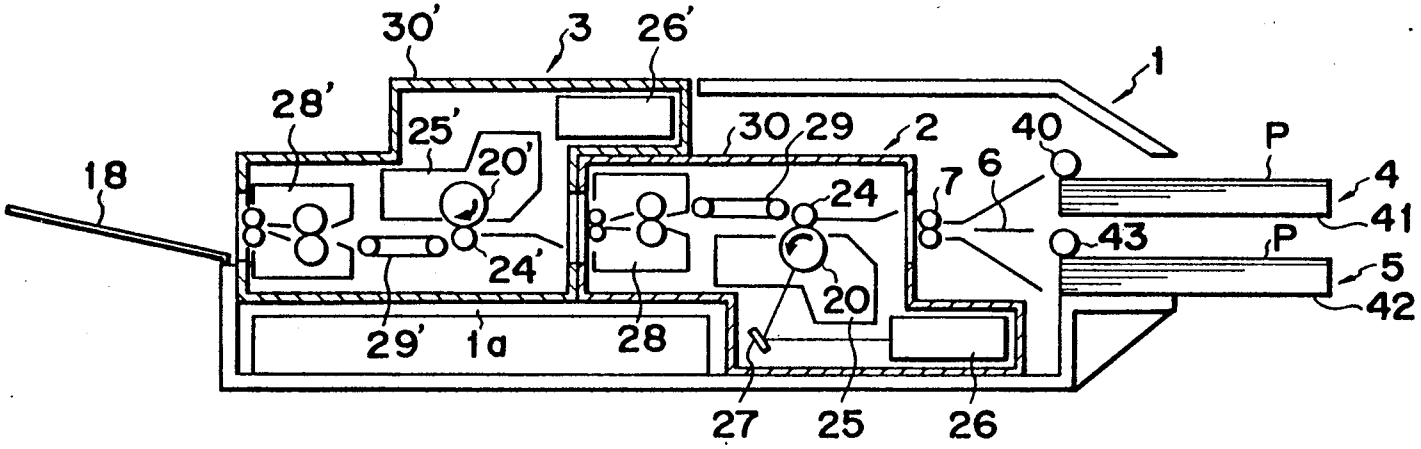
FIG. 20 is an elevational sectional view of an alteration of the image forming apparatus according to the second embodiment of the present invention.

Incidentally, in these embodiment, as shown in FIG. 20, by removing a portion of the base 1*a* of the image forming apparatus 1 and by mounting the first image forming unit 2 in the turned-over condition, it is possible to effect the double-surface print on the single transfer sheet.

As apparent from the aforementioned explanation, according to these embodiments (FIGS. 17 to 20) of the present invention, when only the first image forming unit 2 is mounted on the image forming apparatus, the unit can be used as the normal image forming means for forming the image on only one surface of the transfer sheet. And, when the second image forming unit having the same function and size as the first image forming unit is additionally mounted on the image forming apparatus, it is possible to form the image by using the first and second image forming units independently, or it is possible to easily form various images (multi-print, double-surface print and the like) by the combination of the first and second image forming units.

Next, a further embodiment wherein a trailing end of the transfer sheet can be positively passed through the fixing device will be explained with reference to FIG. 21.

Figure 21:
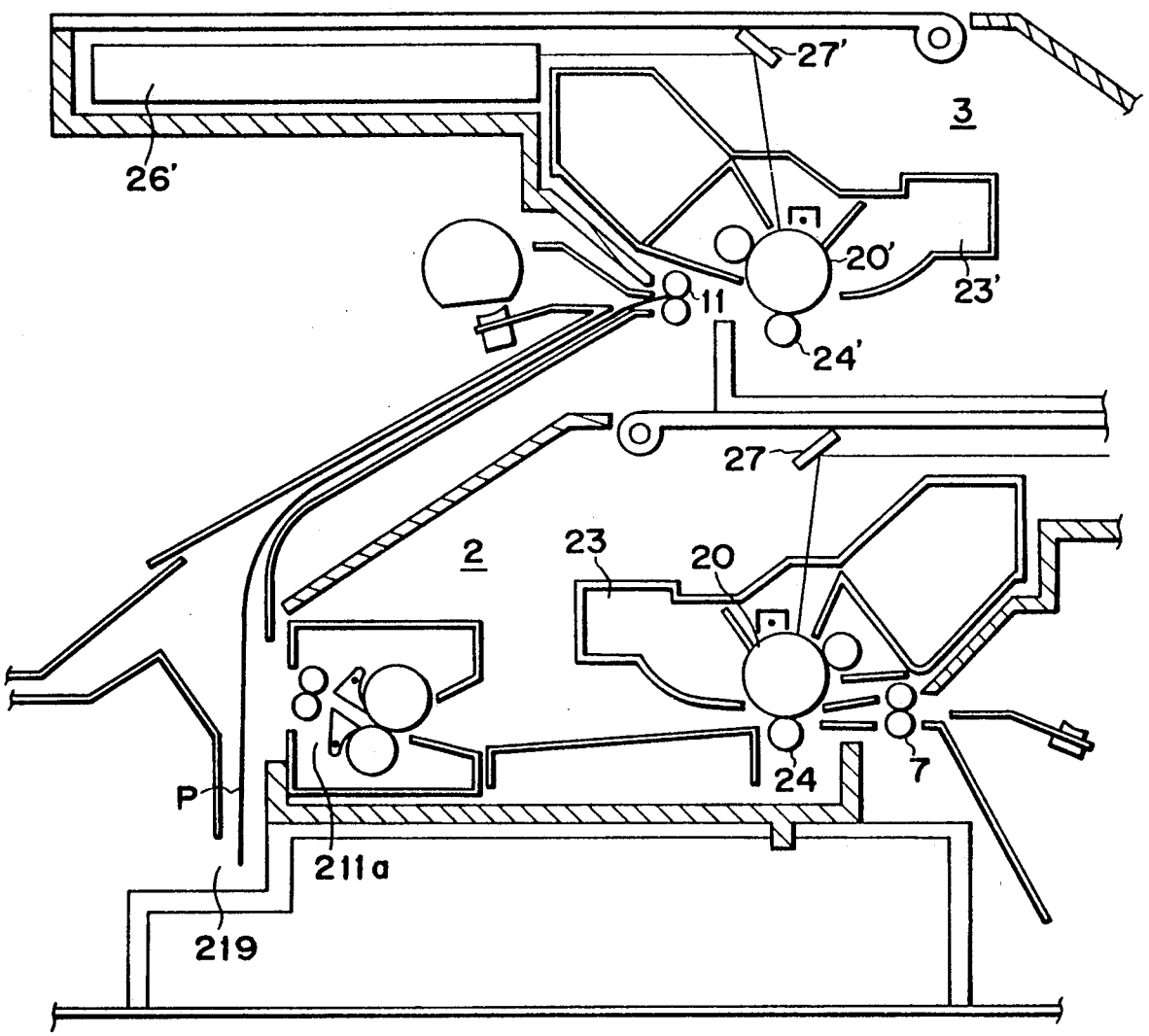
FIG. 21 is an enlarged elevational sectional view of a main portion of the image forming apparatus of FIG. 1.

In FIG. 21, the reference numeral 219 denotes an area for accommodating a trailing end portion of the ejected transfer sheet P. Incidentally, in this image forming apparatus, when the a length of the smallest transfer sheet to be treated is L and a distance between a fixing station 211*a* and the register rollers 11 is l, the relationship L>l is established.

The transfer sheet P passed through the fixing station 211*a* reaches the register rollers 11, where the transfer sheet is temporarily stopped. However, since the minimum length L of the transfer sheet P is larger than the distance l between the fixing station 211*a* and the register rollers 11, the trailing end of the transfer sheet P remains in the fixing station 211*a*. In this case, according to the conventional apparatus, it is feared that the trailing end of the transfer sheet is baked or curled.

Further, when the transfer sheet P is printed in the second image forming unit 3, if the trailing end of the transfer sheet is subjected to a conveying drive force from the fixing station 211*a*, the deviation or blur and pitch irregularity will occur in the image. However, in this embodiment, even after the transfer sheet P has reached the register rollers, the transfer sheet P is ejected from the fixing station 211*a* without stopping the L- operation of the fixing station 211*a*. Further, when the ejected transfer sheet P have the maximum length, the trailing end of the transfer sheet can be introduced into the accommodating area 219 by its own weight.

In this way, since the transfer sheet is not stopped during the fixing operation, the trailing end of the sheet cannot be baked and/or curled, and the blur and/or pitch irregularity in the image can be prevented.

Figure 22:
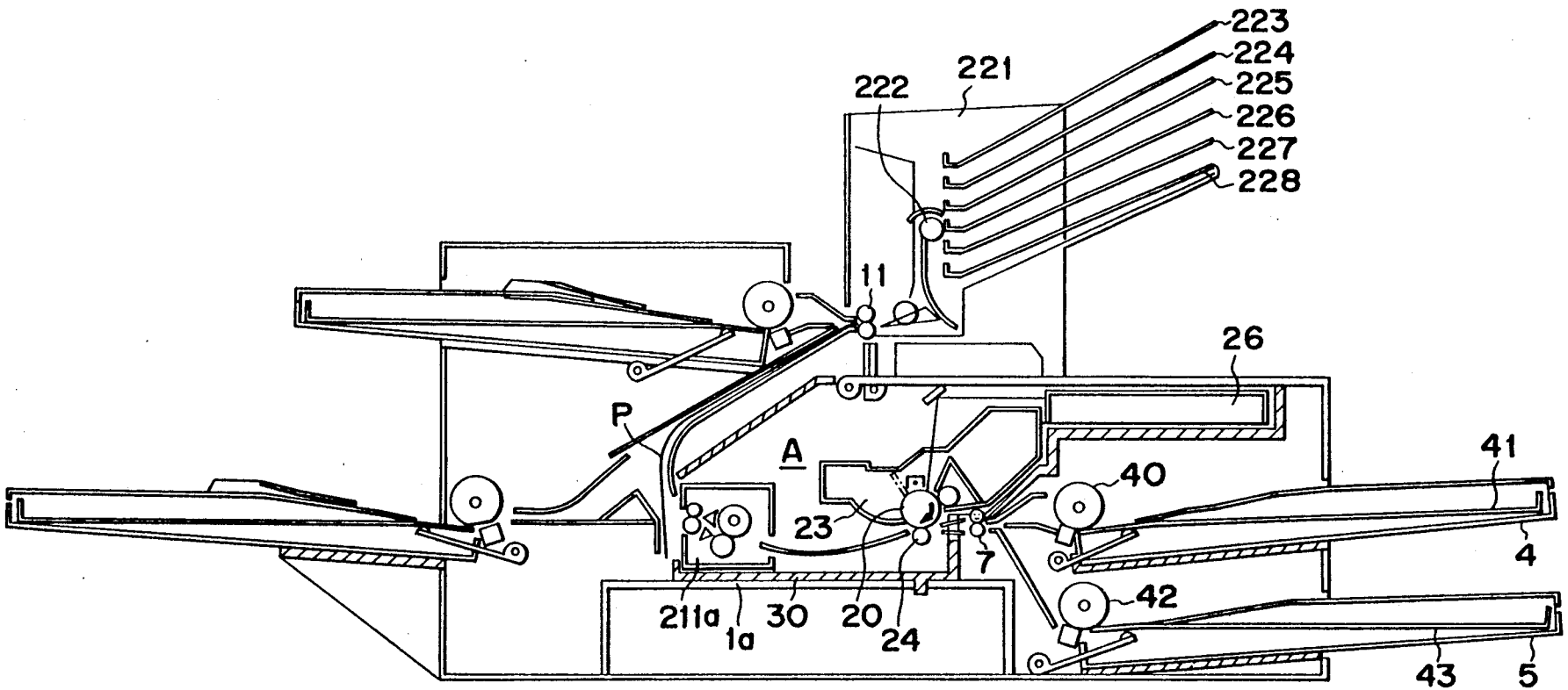
FIG. 22 is an elevational sectional view of an image forming apparatus according to a further embodiment 1 of the present invention.

In FIG. 22 showing a further embodiment of the image forming apparatus having the above-mentioned accommodating area, in an elevational section, the reference numeral 11 denotes the above-mentioned ejector rollers; 221 denotes a sorter; and 222 denotes a sorter ejecting rollers. Incidentally, the elements having the same function as those in the previous embodiments are designated by the same reference numerals and the explanation thereof will be omitted.

The sorter 221 can distribute the transfer sheets P by selecting a desired tray among trays 223–228 and by lifting or lowering the sorter ejecting rollers 222 to the desired tray. When it takes a long time for the sorter to select the desired tray, the ejecting timing to the sorter is adjusted by turning the ejector rollers 11 of the image forming apparatus ON or OFF.

To this end, the fixing station 211*a* is activated so that the trailing end of the transfer sheet does not remain in the fixing station 211*a*, and the trailing end of the transfer sheet P is accommodated in the accommodating area 219, as similar to the previous embodiment.

Figure 23:
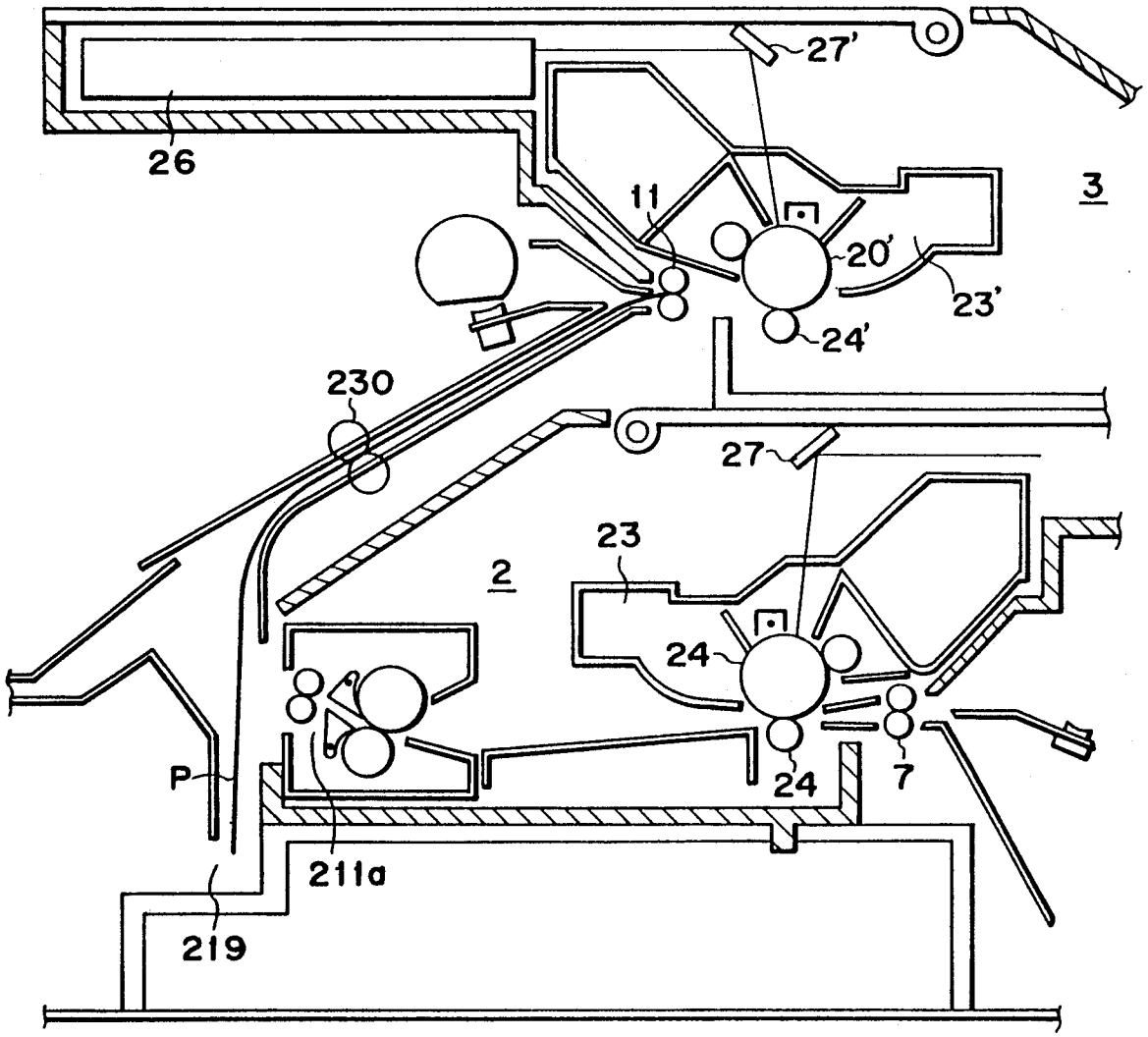
FIG. 23 is an elevational sectional view of an image forming apparatus according to a further embodiment of the present invention.

FIG. 23 shows a still further embodiment of the image forming apparatus having the above-mentioned accommodating area, in an elevational section. The reference numeral 230 denotes one-way rollers. Incidentally, the elements having the same function as those in the previous embodiment are designated by the same reference numerals and the explanation thereof will be omitted.

The transfer sheet P passed through the fixing station 211*a* passes through the one-way rollers 230 and then reaches the register rollers 11, where the leading end of the transfer sheet is nipped by the register rollers 11. Then, the transfer sheet is moved until the trailing end of the sheet is moved out of the fixing station 211*a*. The trailing end of the sheet is accommodated into the accommodating area 219. However, in some apparatus, the register rollers 11 are disposed for above the fixing station 211*a*.

In this case, it is feared that, due to the weight of the transfer sheet itself, the transfer sheet is released from the nip between the register rollers 11 and is dropped downwardly.

However, in this embodiment, since the one-way rollers 230 are provided, the transfer sheet is prevented from being released from such nip and form being dropped, thus eliminating the above inconvenience.

Since the above embodiments (FIGS. 21 to 23) of the present invention have the features as mentioned above, the blur and/or pitch irregularity in the image is prevented, and the transfer sheet is also prevented from being baked and/or curled.

We claim:

1. An image forming apparatus comprising a first image forming unit incorporating an image formation process means therein, a sheet supply portion for feeding a sheet to said first image forming unit, and a sheet ejecting portion for ejecting the sheet on which an image is formed by said first image forming unit out of the image forming apparatus, characterized by that:

a second image forming unit having the same function and size as said first image forming unit is mounted within the image forming apparatus and a sheet inlet of said second image forming unit is directly connected to said sheet ejecting portion, said sheet ejecting portion having a roller functioning as ejector roller when said second image forming unit is not mounted and functioning as register roller for said image forming apparatus when said second image forming unit is mounted.

2. An image forming apparatus according to claim 1, wherein said second image forming unit is disposed above said first image forming unit in such a manner that a sheet feeding direction in said second image forming unit is opposite to that in said first image forming unit, and a sheet feeding path of said sheet ejecting portion is curved in a substantially U-shaped configuration.

3. An image forming apparatus according to claim 1 or 3, wherein a branched path is provided in a sheet feeding path of said sheet ejecting portion, and the sheet can be ejected out of the image forming apparatus through said branched path.

4. An image forming apparatus comprising a first sheet supplying means for supplying a sheet from a sheet stack, a first image forming portion where an image is formed on the supplied sheet, and an ejecting/-stacking means on which the sheets each having the image formed in said first image forming portion are ejected/stacked, characterized by a sheet re-feeding means for directing the sheets stacked on said ejecting/stacking means to a detachable second image forming portion different from said first image forming portion and a path for introducing the sheet on which the image is formed at said first image forming portion after reversing its front and rear surfaces.

5. An image forming apparatus according to claim 4, wherein said ejecting/stacking means has a sheet cassette, and said sheet cassette is removable with respect to the image forming apparatus.

6. An image forming apparatus according to claim 5, wherein the sheets ejected from said first image forming portion are ejected and stacked in said sheet cassette.

7. An image forming apparatus according to claim 4, wherein when said first and second image forming portions are connected to each other, a register mechanism for temporarily stopping the feeding of the sheet to the downstream image forming portion, in a sheet feeding path between the upstream image forming portion and the downstream image forming portion is provided.

8. An image forming apparatus, comprising a first sheet supplying means for supplying a sheet from a sheet stack, a first image forming portion where an image is formed on the supplied sheet, and an ejecting/-stacking means on which the sheets each having the image formed in said first image forming portion are ejected/stacked, wherein a sheet re-feeding means for directing the sheets stacked on said ejecting/stacking means to a second image forming portion different from said first image forming portion is provided and wherein said first and second image forming image portions each including a series of image means therein and are removably mounted on the image forming apparatus in opposite orientations so that a sheet feeding direction in the first image forming portion is opposite to that in the second image forming portion, and multi-print, double-surface print or independent single-surface prints can be effected by said first and second image forming portions; and wherein each of said first and second image forming portions has input portions for receiving a driving force from the image forming apparatus, at both sides of a sheet feeding path thereof, whereby the driving force can be transmitted to said image forming portion from either side of the sheet feeding path.

9. An image forming apparatus according to claim 8, wherein said series of images forming means include an electrophotographic processing means, fixing means and optical system unit.

10. An image forming apparatus according to claim 8 or 9, wherein said input portions of said image forming portion are disposed at either side of an image bearing member of said electrophotographic processing means or said fixing means.

11. An image forming apparatus according to claim 9, wherein a regulating means for regulating the feeding of the sheet is arranged at a downstream side of said fixing means, and wherein a trailing end of the sheet can be ejected out of said fixing means regardless of the operation of said regulating means.

12. An image forming apparatus according to claim 11, wherein a length of a path between said regulating means and said fixing means is longer than a maximum length of the sheet to be fed.

13. An image forming apparatus according to claim 12, further including an accommodating area for accommodating the trailing end of the ejected sheet.

* * * * *

UNITED STATES PATENT AND TRADEMARK OFFICE

CERTIFICATE OF CORRECTION

PATENT NO. : 5,115,281

DATED : May 19, 1992

INVENTOR(S) : OHTSUKA et al.

It is certified that error appears in the above-identified patent and that said Letters Patent is hereby corrected as shown below:

COLUMN 2

Line 9, "inlet exit" should read --sheet inlet--.

COLUMN 6

Line 53, "unit 2" should read --unit 3--.
Line 54, "replaced" should read --replaced with--.

COLUMN 7

Line 18, "unit 2" should read --unit 3--.

COLUMN 8

Line 1, "to" should be deleted.
Line 11, "an" should read --a--.
Line 55, "6, 26′ " should read --26, 26′--.

COLUMN 9

Line 10, "roller 4-1" should read --roller 44-1 --.
Line 31, "reached" should read --reaching--.

UNITED STATES PATENT AND TRADEMARK OFFICE

CERTIFICATE OF CORRECTION

PATENT NO. : 5,115,281

DATED : May 19, 1992

INVENTOR(S) : OHTSUKA et al.

It is certified that error appears in the above-identified patent and that said Letters Patent is hereby corrected as shown below:

COLUMN 10

Line 28, "which" should read --to which--.
Line 46, "is" should read --are--.

COLUMN 11

Line 32, "increasing;" should read --increases;--.

COLUMN 12

Line 27, "and" should read --or--.

COLUMN 14

Line 4, "long" should read --much--.
Line 5, "possible" should read --possible.--
Line 25, "o" should be deleted.

UNITED STATES PATENT AND TRADEMARK OFFICE

CERTIFICATE OF CORRECTION

PATENT NO. : 5,115,281

DATED : May 19, 1992

INVENTOR(S) : OHTSUKA et al.

It is certified that error appears in the above-identified patent and that said Letters Patent is hereby corrected as shown below:

COLUMN 15

Line 2, "train 150" should read --train 115--.
Line 38, "which" should read --which is-- and "makes inexpensive as" should read --makes the device as inexpensive--.
Line 39, "long" should be deleted.

COLUMN 16

Line 15, "assorting" should read --sorting--.
Line 19, "assorted" should read --sorted--.

COLUMN 17

Line 2, "a" should be deleted.
Line 23, "L-" should be deleted.

COLUMN 18

Line 1, "for" should be deleted.
Line 9, "form" should read --from--.

UNITED STATES PATENT AND TRADEMARK OFFICE

CERTIFICATE OF CORRECTION

PATENT NO. : 5,115,281

DATED : May 19, 1992

INVENTOR(S) : OHTSUKA et al.

It is certified that error appears in the above-identified patent and that said Letters Patent is hereby corrected as shown below:

COLUMN 20

Line 7, "images" should read --image--; and "include" should read --includes--.

Signed and Sealed this

Twenty-eighth Day of September, 1993

Bruce Lehman

*Attest:*

BRUCE LEHMAN

*Attesting Officer*

*Commissioner of Patents and Trademarks*